US006691082B1

(12) United States Patent
Aguilar et al.

(10) Patent No.: US 6,691,082 B1
(45) Date of Patent: Feb. 10, 2004

(54) METHOD AND SYSTEM FOR SUB-BAND HYBRID CODING

(76) Inventors: Joseph Gerard Aguilar, 3 Hanson Pl., Princeton, NJ (US) 08540; Juin-Hwey Chen, 68 Longfield Dr., Neshanic Station, NJ (US) 08853; Vipul Parikh, 8109 Glenhurst Dr., Fairfax Station, VA (US) 22039; Xiaoqin Sun, 139 Tennyson Dr., Plainsboro, NJ (US) 08536

( * ) Notice: Subject to any disclaimer, the term of this patent is extended or adjusted under 35 U.S.C. 154(b) by 414 days.

(21) Appl. No.: 09/630,804

(22) Filed: Aug. 2, 2000

Related U.S. Application Data

(60) Provisional application No. 60/146,839, filed on Aug. 3, 1999.

(51) Int. Cl.[7] ..... G10L 19/02

(52) U.S. Cl. ..... 704/219; 704/221

(58) Field of Search ..... 704/200, 207, 704/214, 219, 220, 221, 225, 501, 504

(56) References Cited

U.S. PATENT DOCUMENTS 4,622,680 A * 11/1986 Zinser ..... 704/219
4,677,671 A * 6/1987 Galand et al. ..... 704/219
5,001,758 A * 3/1991 Galand et al. ..... 381/36
5,774,837 A * 6/1998 Yeldener et al. ..... 704/208

OTHER PUBLICATIONS

Zurada, Introduction to Artificial Neural Systems, pp. 186–190, "Error Back–propagation Training," West Publishing Company, © 1992.

ITU–T, G.729, 3/96, "General Aspects Of Digital Transmission Systems," "Coding of Speech At 8 kbit/s Using Conjugate–Structure Algebraic–Code–Excited Linear–Prediction (CS–ACELP)", © ITU 1996.

Kleijn, et al., "A 5.85 kb/s Celp Algorithm For Cellular Applications," pp II–596–II–599, 0–7803–0946–4/93, © 1993 IEEE.

Eriksson, et al., "Exploiting Interframe Correlation In Spectral Quantization," pp 765–768, 0–7803–2127–8/94 © 1995 IEEE.

* cited by examiner

*Primary Examiner*—Daniel Abebe

(57) ABSTRACT

A system and method are provided for processing audio and speech signals using a pitch and voicing dependent spectral estimation algorithm (voicing algorithm) to accurately represent voiced speech, unvoiced speech, and mixed speech in the presence of background noise, and background noise with a single model. The present invention also modifies the synthesis model based on an estimate of the current input signal to improve the perceptual quality of the speech and background noise under a variety of input conditions. The present invention also improves the voicing dependent spectral estimation algorithm robustness by introducing the use of a Multi-Layer Neural Network in the estimation process. The voicing dependent spectral estimation algorithm provides an accurate and robust estimate of the voicing probability under a variety of background noise conditions. This is essential to providing high quality intelligible speech in the presence of background noise. In one embodiment, the waveform coding is implemented by separating the input signal into at least two sub-band signals and encoding one of the at least two sub-band signals using a first encoding algorithm to produce at least one encoded output signal; and encoding another of said at least two sub-band signals using a second encoding algorithm to produce at least one other encoded output signal, where the first encoding algorithm is different from the second encoding algorithm. In accordance with the described embodiment, the present invention provides an encoder that codes N user defined sub-band signal in the baseband with one of a plurality of waveform coding algorithms, and encodes N user defined sub-band signals with one of a plurality of parametric coding algorithms. That is, the selected waveform/parametric encoding algorithm may be different in each sub-band.

36 Claims, 19 Drawing Sheets

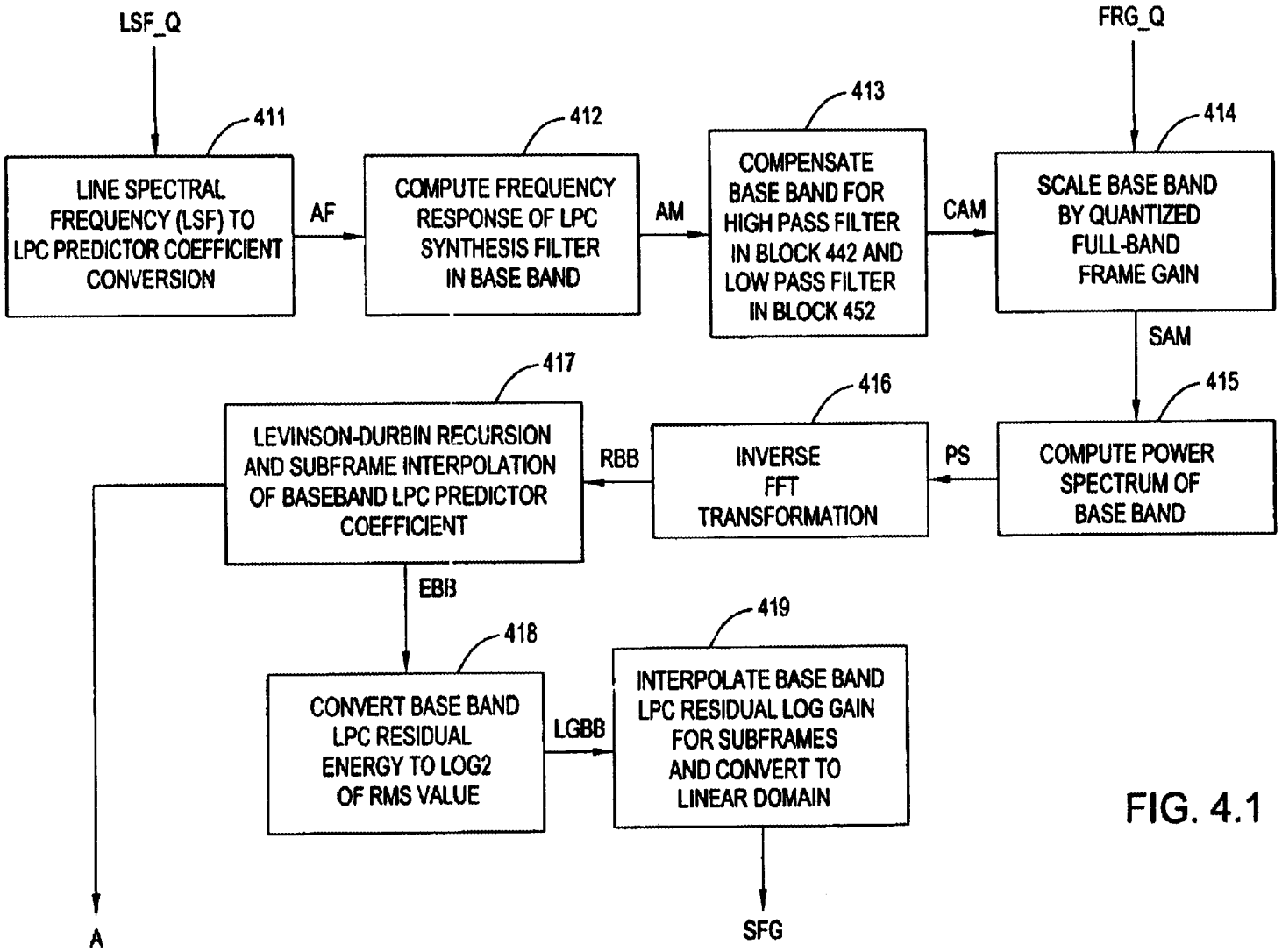
FIG. 4.1

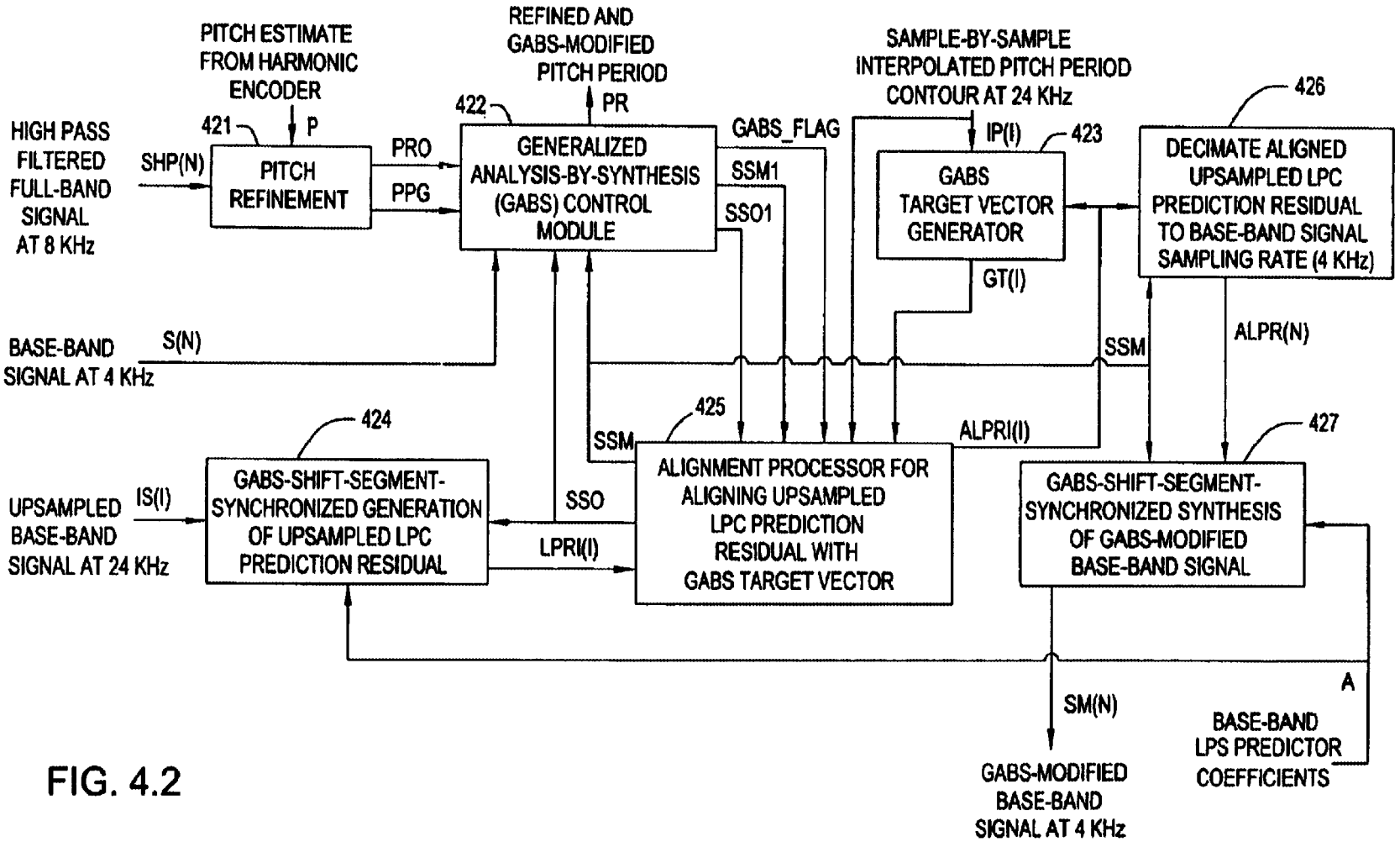
FIG. 4.2

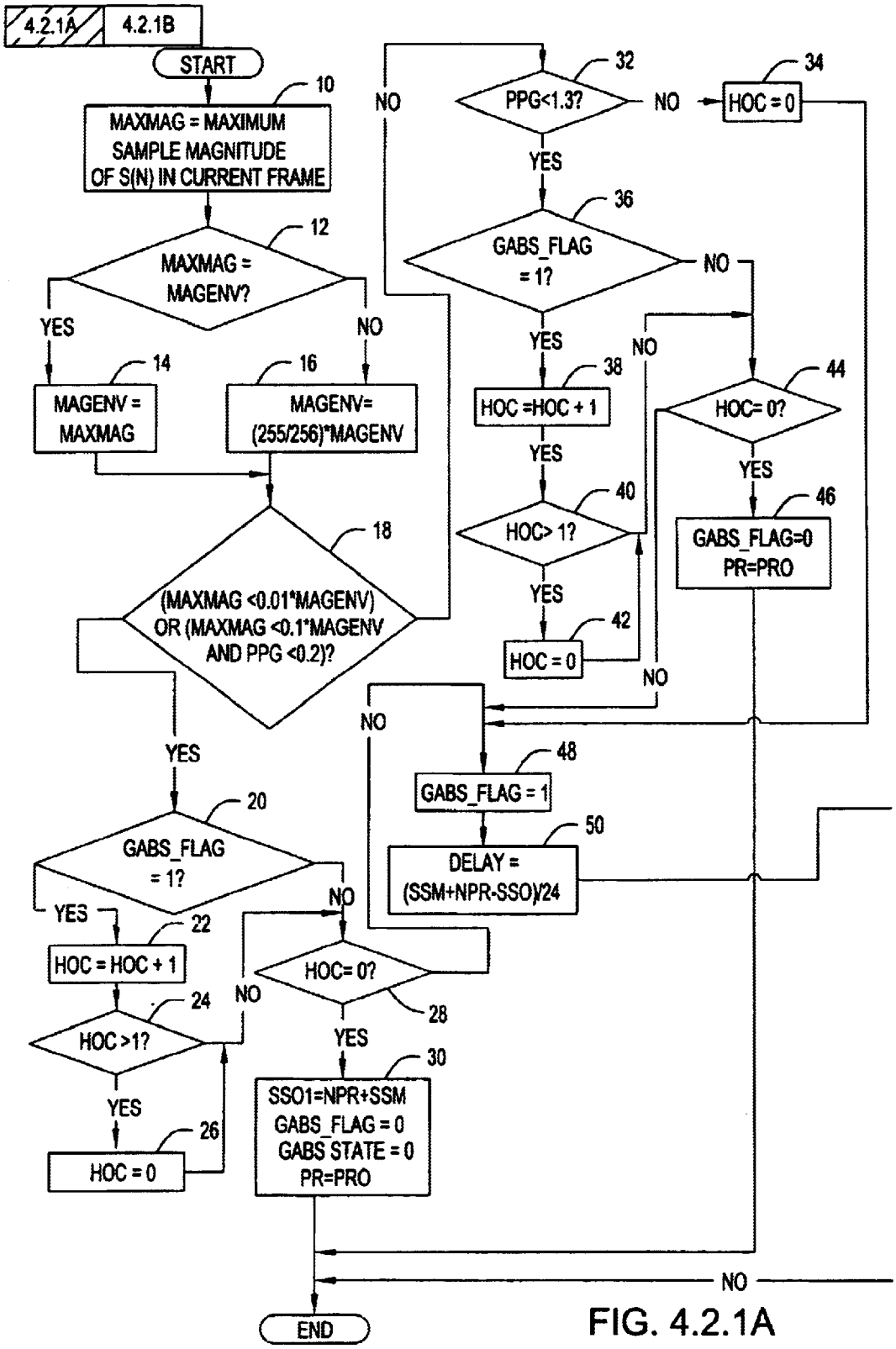
FIG. 4.2.1A

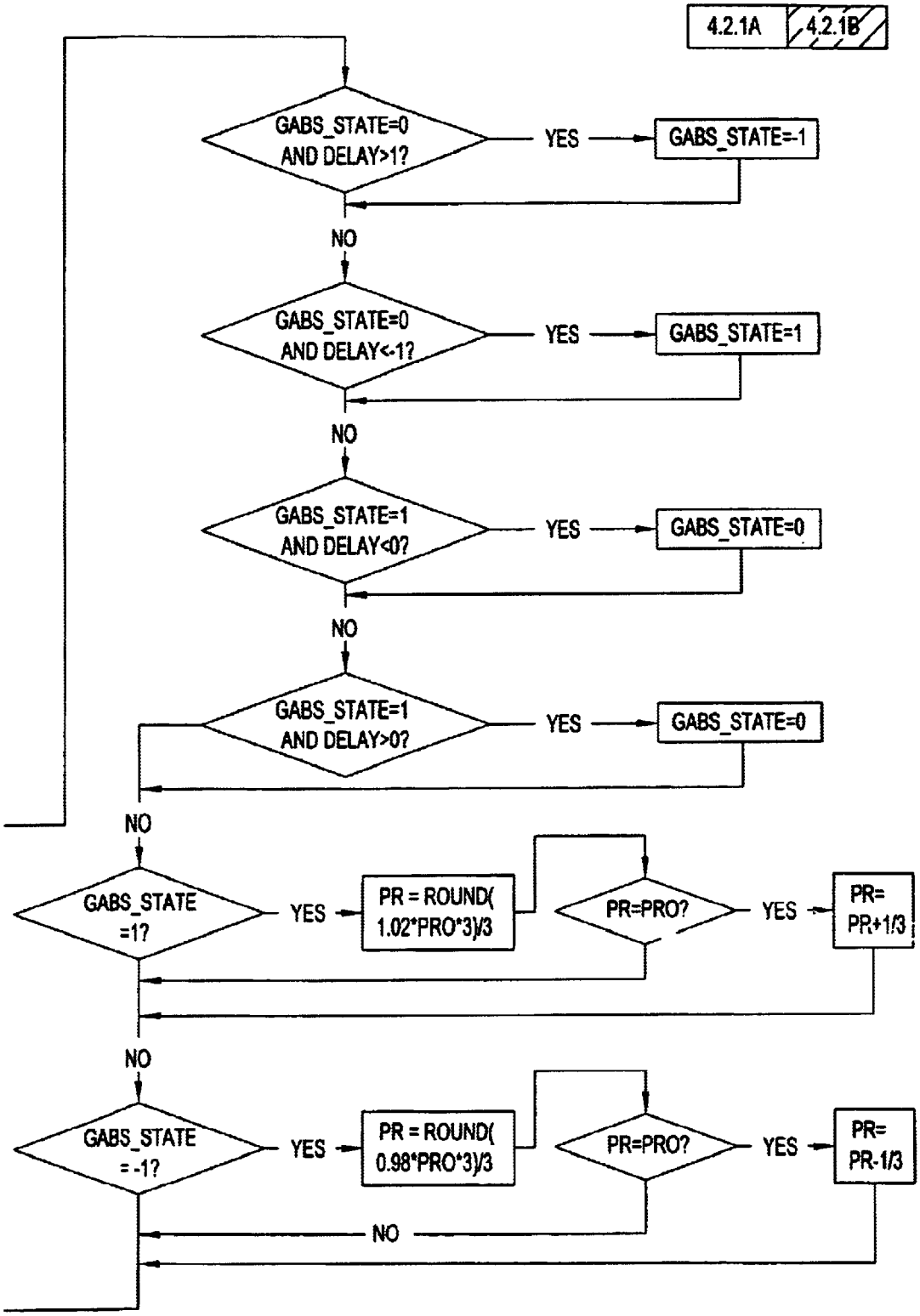
FIG. 4.2.1B

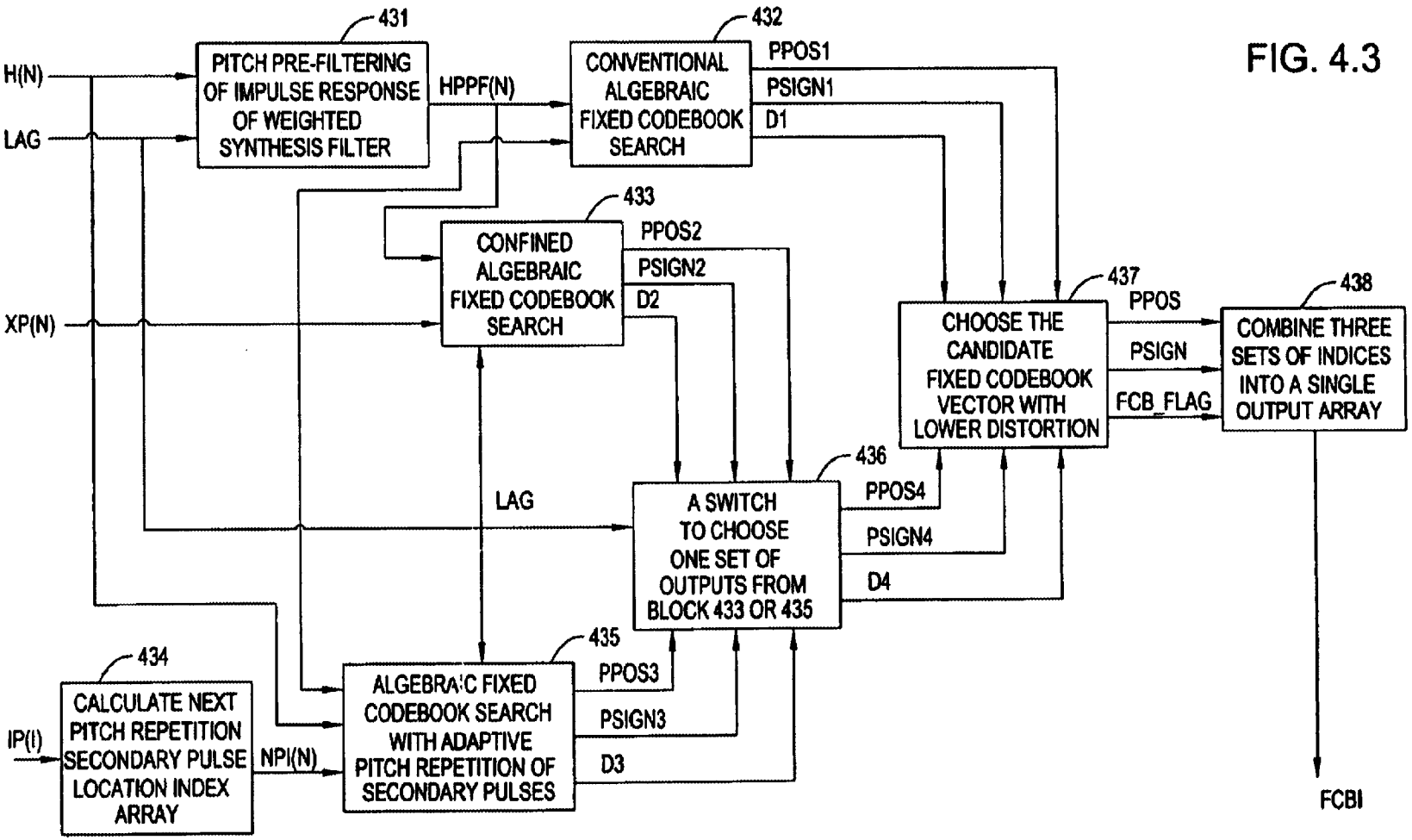
FIG. 4.3
431
PITCH PRE-FILTERING OF IMPULSE RESPONSE OF WEIGHTED SYNTHESIS FILTER
HPPF(N)
432
CONVENTIONAL ALGEBRAIC FIXED CODEBOOK SEARCH
PPOS1
PSIGN1
D1
433
CONFINED ALGEBRAIC FIXED CODEBOOK SEARCH
PPOS2
PSIGN2
D2
LAG
436
A SWITCH TO CHOOSE ONE SET OF OUTPUTS FROM BLOCK 433 OR 435
PPOS4
PSIGN4
D4
435
ALGEBRAIC FIXED CODEBOOK SEARCH WITH ADAPTIVE PITCH REPETITION OF SECONDARY PULSES
PPOS3
PSIGN3
D3
NPI(N)
434
CALCULATE NEXT PITCH REPETITION SECONDARY PULSE LOCATION INDEX ARRAY
437
CHOOSE THE CANDIDATE FIXED CODEBOOK VECTOR WITH LOWER DISTORTION
PPOS
PSIGN
FCB_FLAG
438
COMBINE THREE SETS OF INDICES INTO A SINGLE OUTPUT ARRAY
FCBI
H(N)
LAG
XP(N)
IP(I)

(A) OVER-LAP ADD WINDOW (B) FADE OUT WINDOW (C) MERGE IN WINDOW

METHOD AND SYSTEM FOR SUB-BAND HYBRID CODING

PRIORITY

This application claims priority from a United States Provisional Application filed on Aug. 3, 1999 by Aguilar et al. having U.S. Provisional Application Serial No. 60/146,839, the contents of which are incorporated herein by reference.

BACKGROUND OF THE INVENTION

1. Field of the Invention

The present invention relates generally to speech processing, and more particularly to a sub-band hybrid codec for achieving high quality synthetic speech by combining waveform coding in the baseband with parametric coding in the high band.

2. Description of the Prior Art

The present invention combines techniques common to waveform approximating coding and parametric coding to efficiently perform speech analysis and synthesis as well as coding. These two coding paradigms are combined in a codec module to constitute what is referred to hereinafter as Sub-band Hybrid Vocoding or simply Hybrid coding.

SUMMARY OF THE INVENTION

The present invention provides a system and method for processing audio and speech signals. The system encodes speech signals using waveform coding in the baseband in combination with parametric coding in the high band. In one embodiment, the waveform coding is implemented by separating the input signal into at least two sub-band signals and encoding one of the at least two sub-band signals using a first encoding algorithm to produce an encoded output signal; and encoding another of said at least two sub-band signals using a second encoding algorithm to produce another encoded output signal, where the first encoding algorithm is different from the second encoding algorithm. In accordance with the present disclosure, the present invention provides an encoder that codes N user defined sub-band signals in the baseband with one of a plurality of waveform coding algorithms, and encodes N user defined sub-band signals with one of a plurality of parametric coding algorithms. That is, the selected waveform/parametric encoding algorithm may be different in each sub-band.

In another embodiment, the waveform coding is implemented by a relaxed code excited linear predictor (RCELP) coder, and the high band encoding is implemented with a Harmonic coder. In this embodiment, the encoding method generally comprises the steps of: separating an input speech/audio signal into two signal paths. In the first signal path, the input signal is low pass filtered and decimated to derive a baseband signal. The second signal path is the full band input signal. In one embodiment, at an analysis stage, the fullband input signal is encoded using a Harmonic coding model and the baseband signal path is encoded using an RCELP coding model. The RCELP encoded signal is then combined with the harmonic coded signal to form a hybrid encoded signal.

According to one aspect of the present invention, during synthesis the decoded signal is modeled as a reconstructed sub-band signal driven by the encoded baseband RCELP signal and fullband Harmonic signal. The baseband RCELP signal is reconstructed and low pass filtered and resampled up to the fullband sampling frequency while utilizing a sub-band filter whose cutoff frequency is lower than the analyzers original low pass filter. The fullband Harmonic signal is synthesized while maintaining waveform phase alignment with the baseband RCBLP signal. The fullband Harmonic signal is then filtered using a high pass filter complement of the sub-band filter used on the decoded RCELP baseband signal. The sub-band RCELP and Harmonic signals are then added together to reconstruct the decoded signal. The hybrid codec of the present invention may advantageously be used with coding models other than Waveform and Harmonic models.

The present disclosure also contemplates the simultaneous use of multiple waveform encoding models in the baseband, where each model is used in a prescribed sub-band of the baseband. Preferable, but not exclusive waveform encoding models include at least a pulse code modulation (PCM) encoder, an adaptive differential PCM encoder, a code excited linear prediction (CELP) encoder, a relaxed CELP encoder and a transform coding encoder.

The present disclosure also contemplates the simultaneous use of multiple parametric encoding models in the high band, where each model is used in a prescribed sub-band of the highband. Preferable, but not exclusive parametric encoding models include at least a sinusoidal transform encoder, harmonic encoder, multi band excitation vocoder (MBE) encoder, mixed excitation linear prediction (MELP) encoder and waveform interpolation encoder.

A further advantage of the present invention is that the hybrid codec need not be limited to LPF sub-band RCELP and Fullband Harmonic signal paths on the encoder. The codec can also use more closely overlaping sub-band filters on the encoder. A still further advantage of the hybrid codec is that parameters need not be shared between coding models.

BRIEF DESCRIPTION OF THE DRAWINGS

Various preferred embodiments are described herein with references to the drawings:

FIG. 4.1 is a detailed block diagram of block 410 of FIG. 4 of the present invention;

FIG. 4.2 is a detailed block diagram of block 420 of FIG. 4 of the present invention;

FIG. 4.2.1 is flow chart of block 422 of FIG. 4;

FIG. 4.3 is a block diagram of block 430 of FIG. 4;

DETAILED DESCRIPTION OF THE PREFERRED EMBODIMENTS

Figure 1A:
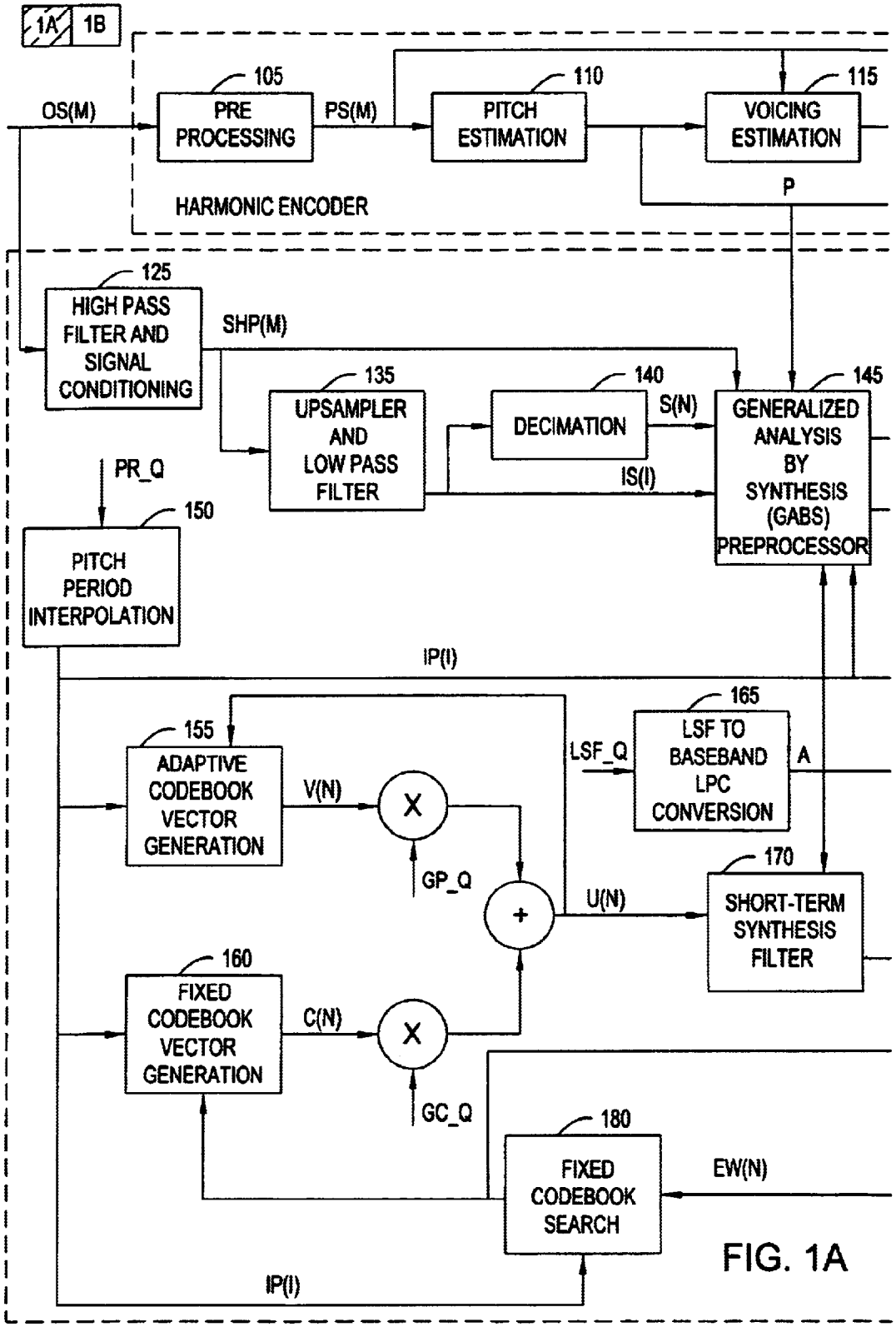
FIG. 1 is a block diagram of a hybrid encoder of the present invention.
Figure 1B:
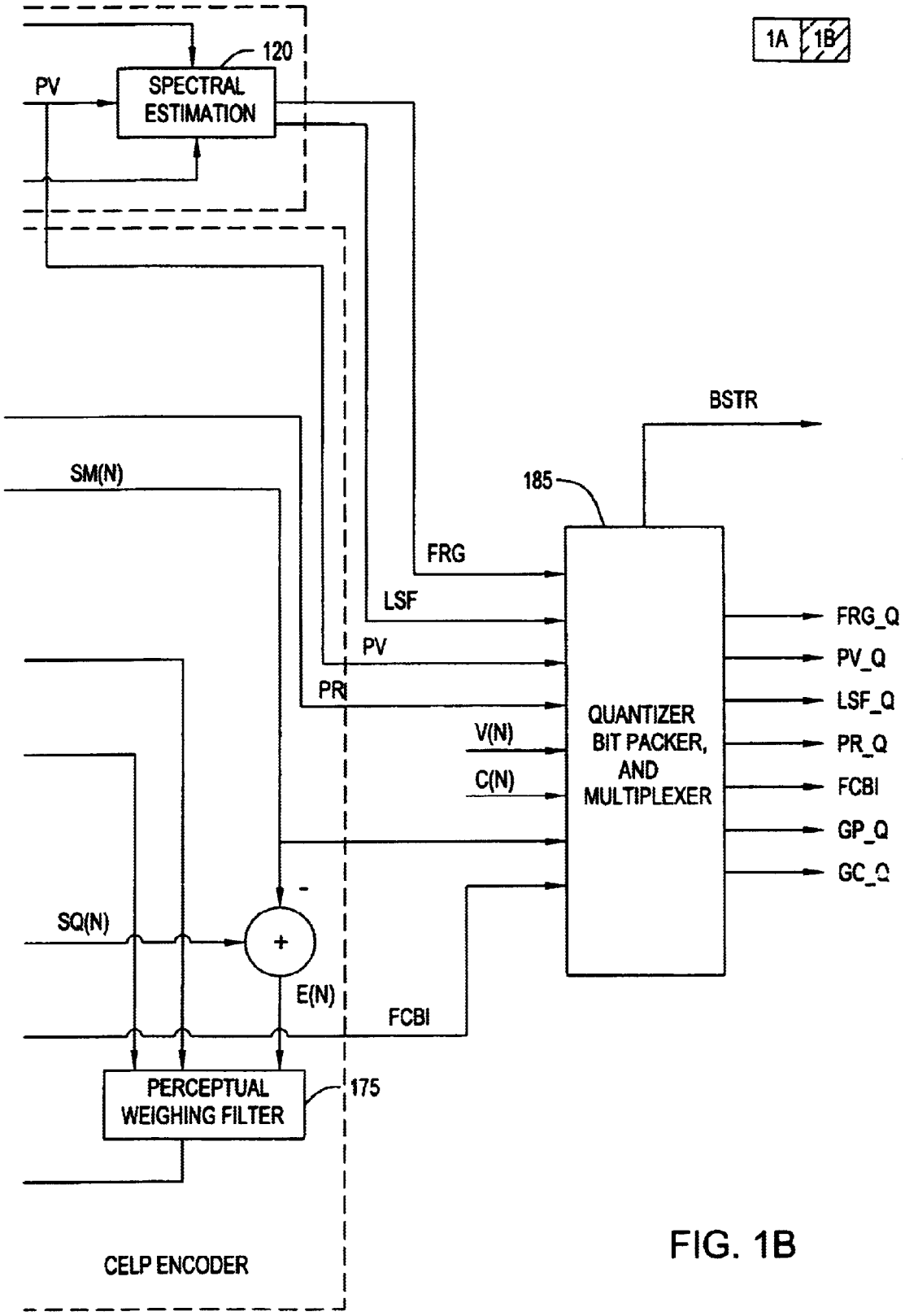

Referring now in detail to the drawings, in which like reference numerals represent similar or identical elements throughout the several views, and with particular reference to FIG. 1, there is shown a general block diagram of a hybrid encoder of the present invention.

I. Hybrid Codec Overview

A. Encoder Overview

FIG. 1 illustrates the Hybrid Encoder of the present invention. The input signal is split into 2 signal paths. A first signal path is fed into the Harmonic encoder, a second signal path is fed into the RCELP encoder. The RCELP coding model is described in W. B. Kleijn, et al., "A 5.85 kb/s CELP algorithm for cellular applications," Proceedings of IEEE International Conference on Acoustic, Speech, and Signal Processing (ICASSP), Minneapolis, Minn., USA, 1993, pp. II-596 to II-599. It is noted that while the enhanced RCELP codec is described in the present application as one building block of a hybrid codec of the present invention, used for coding the baseband 4 kHz sampled signal, it may also be used as a stand-alone codec to code a full-band signal. It is understood by those skilled in the art how to modify the presently described baseband RCELP codec to make it a stand-alone codec.

B. Decoder Overview

Figure 2A:
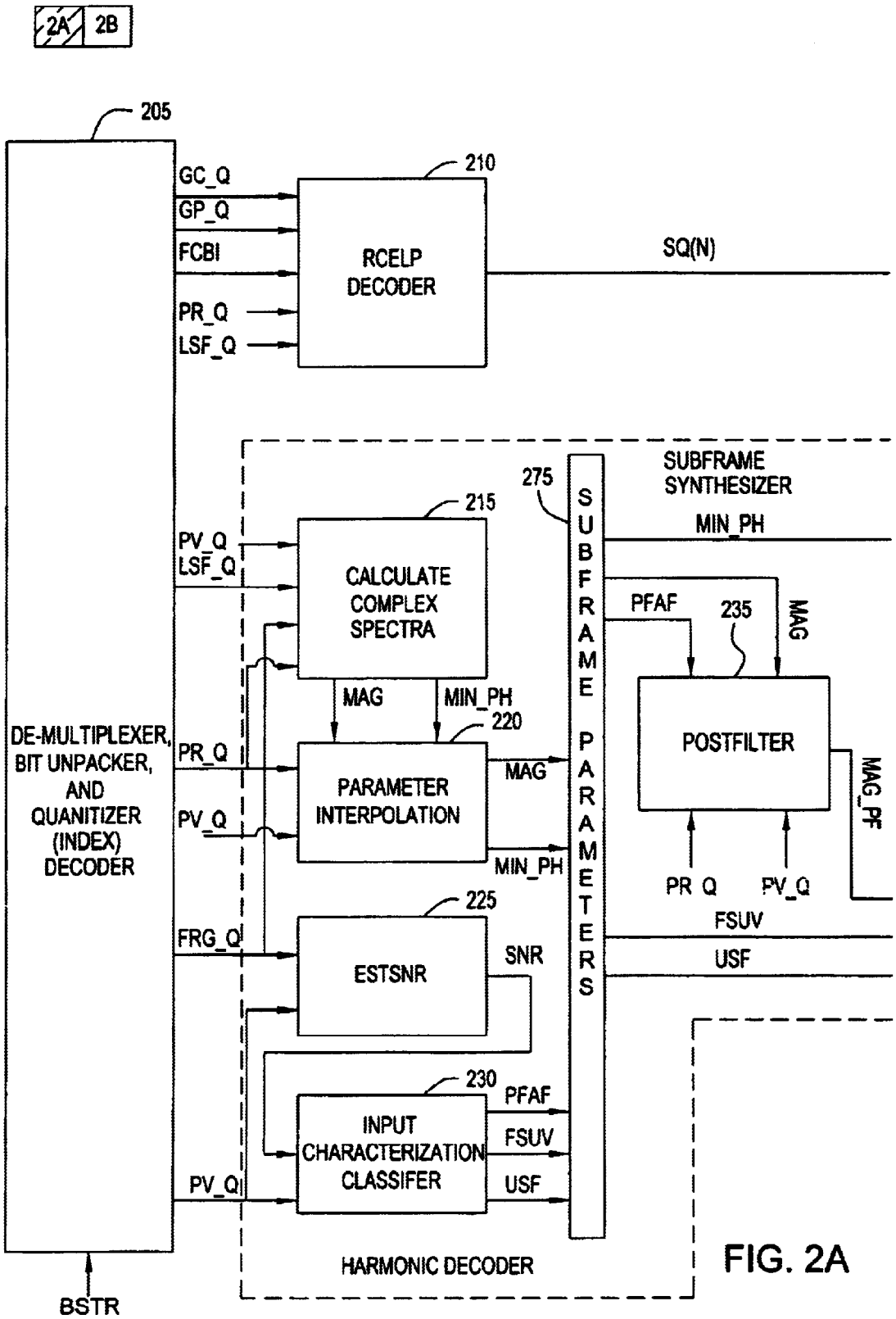
FIG. 2 is a block diagram of a hybrid decoder of the present invention.
Figure 2B:
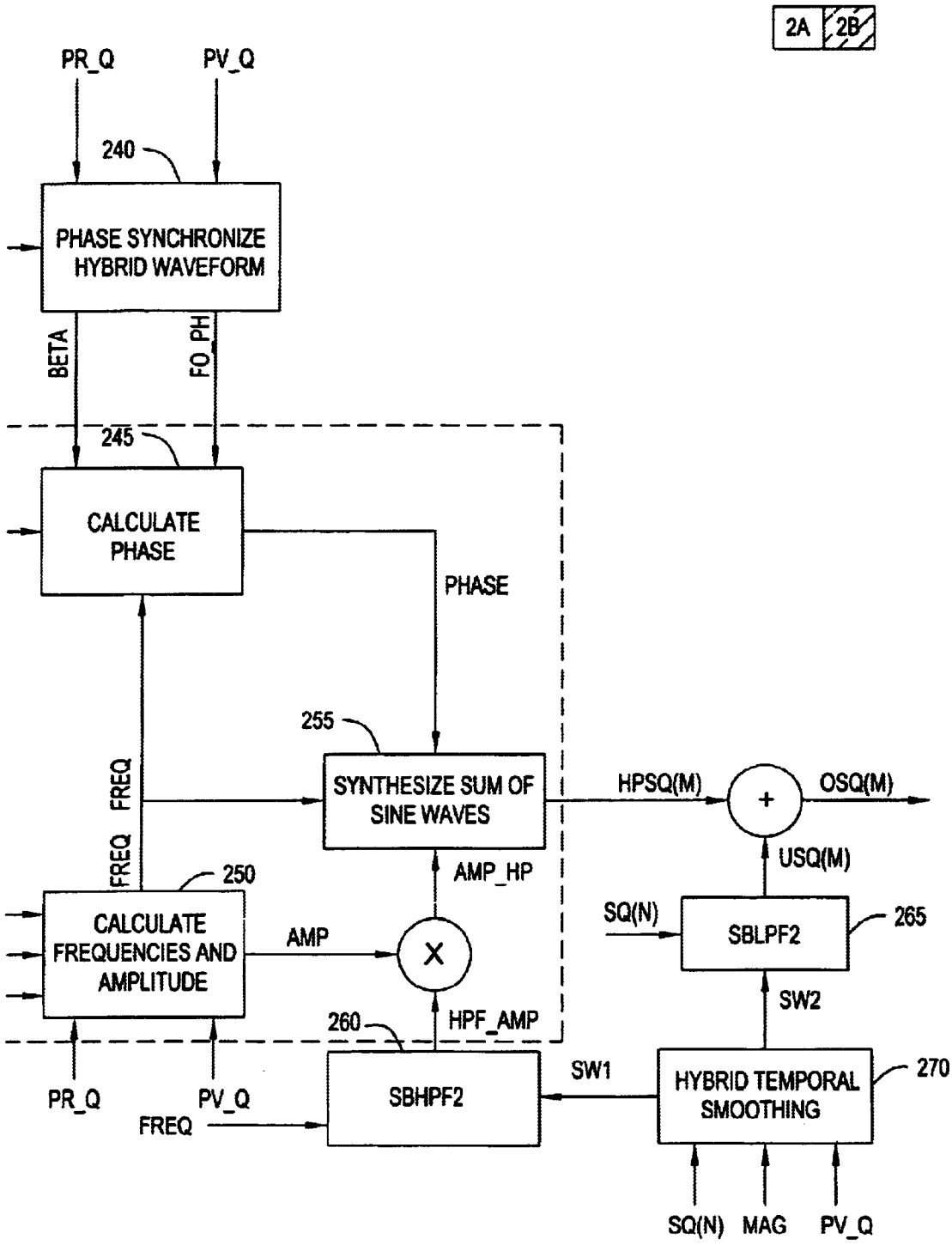

FIG. 2 shows a simplified block diagram of the hybrid decoder. The De-Multiplexer, Bit Unpacker, and Quantizer Index Decoder block 205 takes the incoming bit-stream BSTR from the communication channel and performs the following actions. It first de-multiplexes BSTR into different groups of bits corresponding to different parameter quantizers, then unpacks these groups of bits into quantizer output indices, and finally decodes the resulting quantizer indices into the quantized parameters PR_Q, PV_Q, FRG_Q, LSF_Q, GP_Q, and GC_Q, etc. These quantized parameters are then used by the RCELP decoder and the harmonic decoder to decode the baseband RCELP output signal and the full-band harmonic codec output signal, respectively. The two output signals are then properly combined to give a single final full-band output signal.

Figure 3:
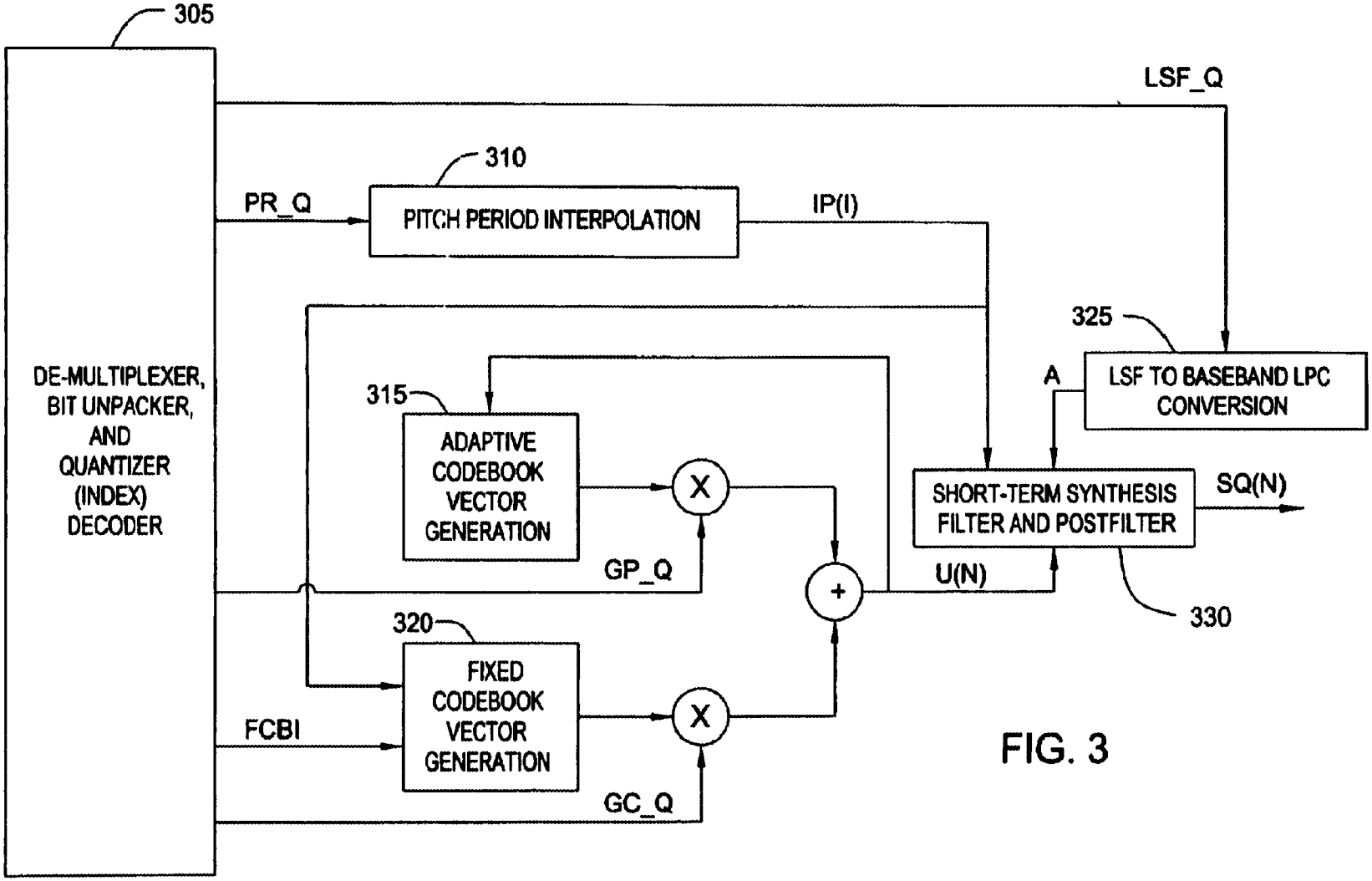
FIG. 3 is a block diagram of a relaxed code excited linear predictor (RCELP) decoder of the present invention.

FIG. 3 shows a simplified block diagram of the baseband RCELP decoder, which is embedded inside block 205 of the hybrid encoder shown in FIG. 2. Most of the blocks in FIG. 3 perform identical operations to their counterparts in FIG. 1.

The LSF to Baseband LPC Conversion block 325 is identical to block 165 of FIG. 1. Conversion block 325 converts the decoded full-band LSF vector LSF_Q into the baseband LPC predictor coefficient array A. The Pitch Period Interpolation block 310 is identical to block 150 of FIG. 1. The pitch period interpolation block 310 takes quantized pitch period PR_Q and generates sample-by-sample interpolated pitch period contour ip(i). Both A and ip(i) are used to update the parameters of the Short-term Synthesis Filter and Post-filter block 330.

The Adaptive Codebook Vector Generator block 315 and the Fixed Codebook Vector Generation block 320 are identical to blocks 155 and 160, respectively. Their output vectors v(n) and c(n) are scaled by the decoded RCELP codebook gains GP_Q and GC_Q, respectively. The scaled codebook output vectors are then added together to form the decoded excitation signal u(n). This signal u(n) is used to update the adaptive codebook in block 315. It is also used to excite the short-term synthesis filter and post-filter to generate the final RCELP decoder output baseband signal sq(n), which is perceptually close to the input baseband signal s(n) in FIG. 1 and can be considered a quantized version of s(n).

The Phase Synchronize Hybrid Waveform block 240 imports the decoded baseband RCELP signal sq(n), pitch period PR_Q, and voicing PV_Q to estimate the fundamental phase F0_PH and system phase offset BETA of the baseband signal. These estimated parameters are used to generate the phase response for the voiced harmonics in the Harmonic decoder. This is performed in order to insure waveform phase synchronization between both sub-band signals.

The Calculate Complex Spectra block 215 imports the spectrum LSF_Q, voicing PV_Q, pitch period PR_Q and gain FRG_Q which are used to generate a frequency domain Magnitude envelope MAG as well as a frequency domain Minimum Phase envelope MIN_PH.

The Parameter Interpolation block 220 imports the spectral envelope MAG, minimum phase envelope MIN_PH, pitch PR_Q, and voicing PV_Q. The Interpolation block then performs parameter interpolation of all input variables in order to calculate two succesive 10 ms sets of parameters for both the middle frame and outer frame of the current 20 ms speech segment.

The EstSNR 225 block imports the gain FRG_Q, and voicing PV_Q. The EstSNR block then estimates the current signal to noise ratio SNR of the current frame.

The Input Characterization Classifier block 230 imports voicing PV_Q, and signal to noise ratio SNR. The Input Characterization Classifier block estimates synthesis control parameters FSUV which controls the unvoiced harmonic synthesis pitch frequency, as well as USF which controls the unvoiced suppression factor, and PFAF which controls the postfilter attenuation factor.

The Subframe Parameters block 275 channels the subframe parameters for the middle and outer frame in sequence for subsequent synthesis operations. The subframe synthesizer will generate two 10 ms frames of speech. For notational simplicity subsequent subframe parameters are denoted as full frame paremeters.

The Postfilter block 235 imports magnitude envelope MAG, pitch frequency PR_Q, voicing PV_Q, and postfilter attentuation factor PFAF. The Postfilter block then modifies the MAG envelope such that it enhances formant peaks while suppressing formant nulls. The postfiltered envelope is then denoted as MAG_PF.

The Calculate Frequencies and Amplitudes block 250 imports the pitch period PR_Q, voicing PV_Q, unvoiced harmonic pitch frequency FSUV, and unvoiced suppression factor USF. The Calculate Frequencies and Amplitudes block calculates the amplitude vector AMP for both the voiced and unvoiced spectral components, as well as the frequency component axis FREQ they are to be synthesized on. This is needed because all frequency components are not necessarily harmonic.

The Calculate Phase 245 block imports the fundamental phase F0_PH, system phase offset BETA, minimum phase envelope MIN_PH, and the frequency component axis FREQ. The Calculate Phase block calculates the phase of all the spectral components along the frequency component axis FREQ and exports them as PHASE.

The Hybrid Temporal Smoothing block 270 imports the RCELP baseband signal sq(n), frequency domain magnitude envelope MAG, and voicing PV_Q. It controls the cutoff frequency of the sub-band filter. It is used to minimize the spectral discontinuities between the two sub-band signals. It exports the cutoff frequency switches SW1 and SW2 which ate sent to the Harmonic sub-band filter and the RCELP sub-band filter respectively.

The SBHPF2 block 260 imports a switch SW1 which controls the cutoff frequency of the Harmonic high pass sub-band filter. The high pass sub-band filter HPF_AMP is then used to filter the amplitude vector AMP which is exported as the high pass filtered amplitude response AMP_HP.

The Synthesize Sum of Sine Waves block 255 imports frequency axis FREQ, high pass filtered spectral amplitudes AMP_HP, and spectral phase response PHASE. The Synthesize Sum of Sine Waves block then computes a sum of sine waves using the complex vectors as input. The output waveform is then overlapped and added with the previous subframe to produce hpsq(n).

The SBLPF2 block 265 imports a switch SW2 which controls the cutoff frequency of the low pass sub-band filter. The low pass sub-band filter is then used to filter and upsample the RCELP baseband signal sq(n) to an 8 kHz signal usq(n).

Finally, the sub-band high pass filtered Harmonic signal hpsq(n) and upsampled RCELP signal usq(n) are combined sample-by-sample to form the final output signal osq(n).

II. Detailed Description of Hybrid Encoder

A. Harmonic Encoder

A.1 Pre Processing

The functionality of the Pre Processing block 105 shown in FIG. 1 is identical to the block 100 of FIG. 1 of Provisional U.S. Application Serial No. 60/195,591.

A.2 Pitch Estimation

The functionality of the Pitch Estimation block 110 shown in FIG. 1 is identical to the block 110 of FIG. 1 of Provisional U.S. Application Serial No. 60/195,591.

A.3 Voicing Estimation

The functionality of the Voicing Estimation block 115 shown in FIG. 1 is identical the block 120 of FIG. 1 of Provisional U.S. Application Serial No. 60/195,591.

A.4 Spectral Estimation

The functionality of the Spectral Estimation block 120 shown in FIG. 1 is identical to the block 140 of FIG. 1 of Provisional U.S. Application Serial No. 60/195,591.

B. RCELP Encoder

Figure 4A:
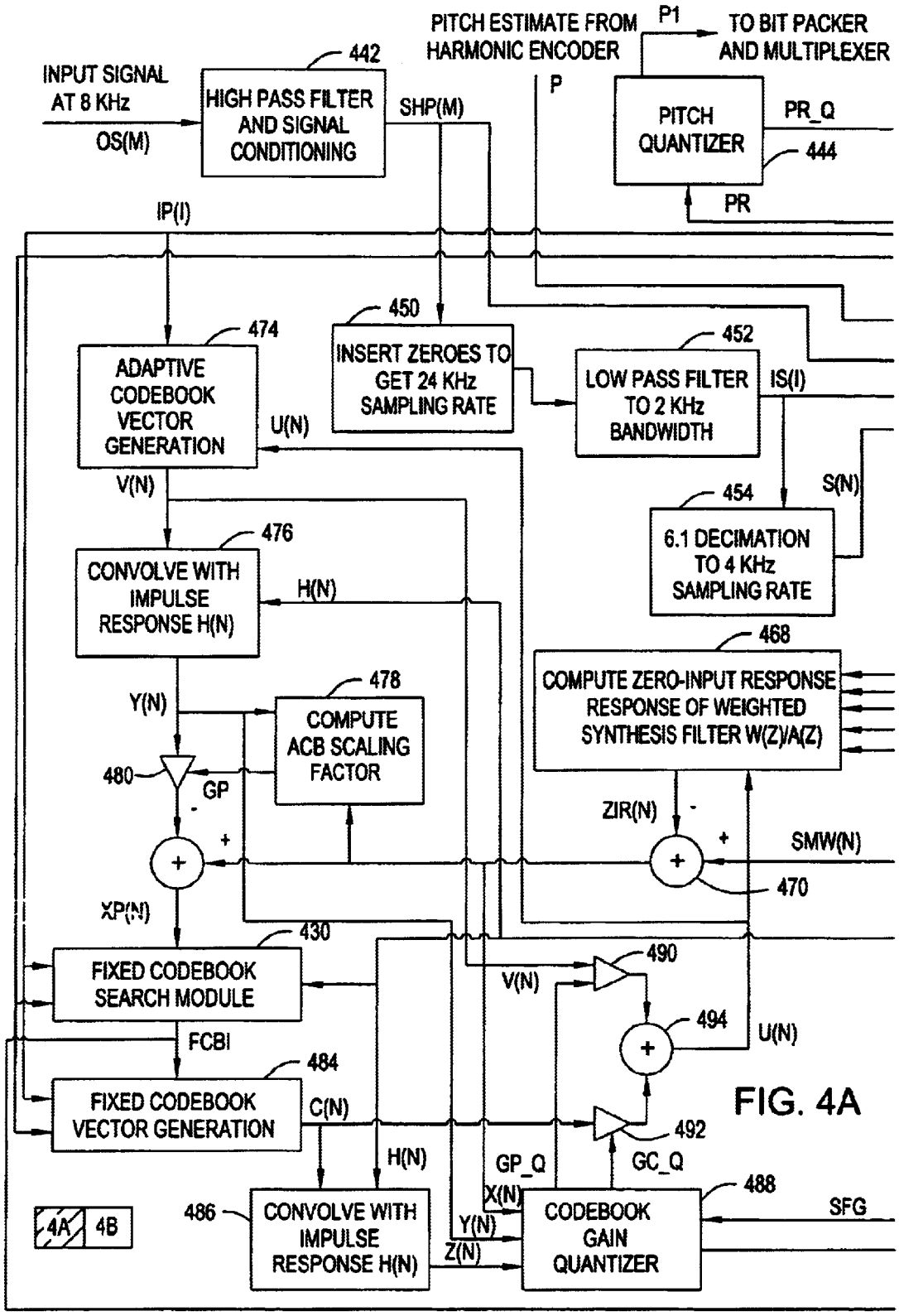
FIG. 4 is a block diagram of a relaxed code excited linear predictor (RCELP) encoder of the present invention.
Figure 4B:
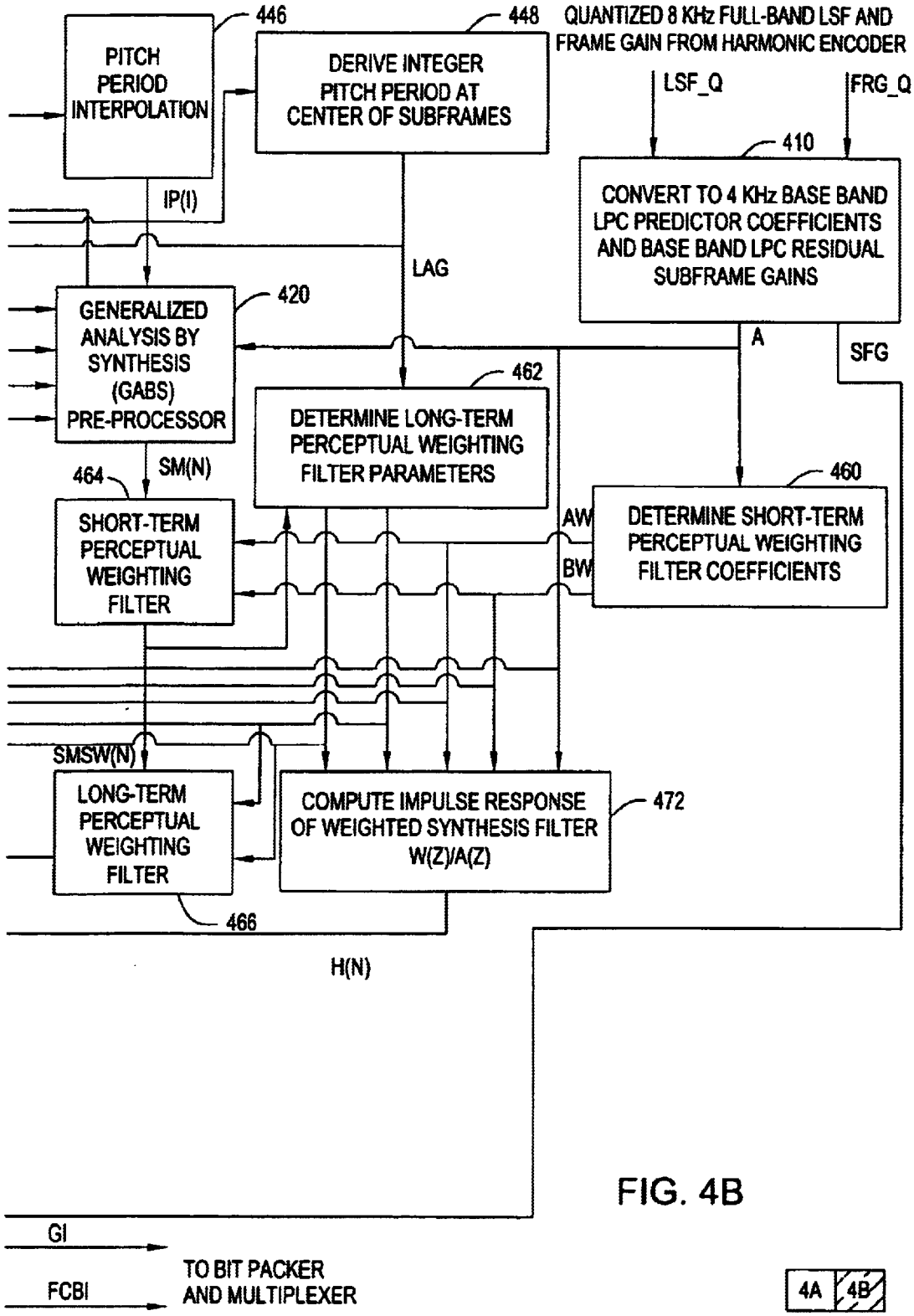

FIG. 4 shows a detailed block diagram of the baseband RCELP encoder. The baseband RCELP encoder takes the 8 kHz full-band input signal as input, derives the 4 kHz baseband signal from it, and then encodes the baseband signal using the quantized full-band LSFs and full-band LPC residual gain from the harmonic encoder. The outputs of this baseband RCELP encoder are the indices PI, GI, and FCBI, which specify the quantized values of the pitch period, the adaptive and fixed codebook gains, and the fixed codebook vector shape (pulse positions and signs), respectively. These indices are then bit-packed and multiplexed with the other bit-packed quantizer indices of the harmonic encoder to form the final output bit-stream of the hybrid encoder. The detailed description of each functional block in FIG. 4 is given below.

B.1 Pre-processing and Sampling Rate Conversion

The 8 kHz original input signal os(m) is first processed by the high pass filter and signal conditioning block 442. The high pass filter used in block 442 is the same as the one used in ITU-T Recommendation G.729, "Coding Of Speech at 8 kbit/s Using Conjugate-Structure Algebraic-Code-Excited Linear-Predicition (CS-CELP)".

Each sample of the high pass filter output signal is then checked for its magnitude. If the magnitude is zero, no change is made to the signal sample. If the magnitude is greater than zero but less than 0.1, then the magnitude is reset to 0.1, while the sign of the signal sample is kept the same. This signal conditioning operation is performed in order to avoid potential numerical precision problems when the high pass filter output signal magnitude decays to an extremely small value close to the underflow limit of the numerical representation used. The output of this signal conditioning operation, which is also the output of block 442, is denoted as shp(m) and has a sampling rate of 8 kHz.

Block 450 inserts two samples of zero magnitude between each pair of adjacent samples of shp(m) to create an output signal with a 24 kHz sampling rate. Block 452 then low pass filters this 24 kHz zero-inserted signal to get a smooth waveform is(i) with a 2 kHz bandwidth. This signal is(i) is then decimated by a factor of 6 by block 454 to get the 4 kHz baseband signal s(n), which is passed to the Generalized Analysis by Synthesis (GABS) pre-processor block 420. The signal is(i) can be considered as a 24 kHz interpolated version of the 4 kHz baseband signal s(n).

The RCELP codec in the preferred embodiment performs most of the processing based on the 4 kHz baseband signal s(n). It is also possible for the GABS pre-processor 420 to perform all of its operations based only on this 4 kHz baseband signal without using is(i) or shp(m). However, we found that GABS pre-processor 420 produces a better quality output signal sm(n) when it also has access to signals at higher sampling rates: shp(m) at 8 kHz and is(i) at 24 kHz, as shown in FIG. 4.

It should be noted that a more conventional way to obtain s(n) and is(i) from shp(m) is to down-sample shp(m) to the 4 kHz baseband signal s(n) first, and then up-sample s(n) to get the 24 kHz interpolated baseband signal is(i). However, this approach requires applying low pass filtering twice: one in down-sampling and one in up-sampling. In contrast, the approach used in the currently proposed codec requires only one low pass filtering operation during up-sampling. Therefore, the corresponding filtering delay and computational complexity are both reduced compared with the conventional method.

It was previously noted that the enhanced RCELP codec of the present invention could also be used as a stand-alone full-band codec of by appropriate modifications. To get a stand-alone 8 kHz full-band RCELP encoder, the low pass filter in block 452 should be changed so it limits the output signal bandwidth to 4 kHz rather than 2 kHz. Also, the decimation block 454 should be deleted since the baseband signal s(n) is no longer needed. The corresponding GABS pre-processor output signal becomes sm(m) at 8 kHz, and all other signals in FIG. 4 that have time index n become 8 kHz sampled and therefore will have time index m instead.

B.2 Pitch Period Quantization and Interpolation

As will described below, the GABS pre-processor block 420 uses shp(m) to refine and possibly modify the pitch estimate obtained at the harmonic encoder. Such operations will be described in detail in the section titled "Pitch." The refined and possibly modified pitch period PR is passed to the pitch quantizer block 444 to quantize PR into PR_Q using an 8-bit non-uniform scalar quantizer with closer spacing at lower pitch period. The corresponding 8-bit quantizer index PI is passed to the bit packer and multiplexer to form the final encoder output bit-stream. The value of the quantized pitch period PR_Q falls in the grid of ⅓ sample resolution at 8 kHz sampling (or 1 sample resolution at 24 kHz).

The pitch period interpolation block 446 generates an interpolated pitch contour for the 24 kHz sampled signal in the current 20 ms frame and extrapolates that pitch contour for the first 2.5 ms of the next frame. This extra 2.5 ms of pitch contour is needed later by the GABS pre-processor 420.

Block 446 first multiplies PR_Q by 3 to get the equivalent pitch period for the 24 kHz sampled signal. Then, it computes the relative percentage change from the 3*PR_Q of the previous frame to the 3*PR_Q of the current frame. If the pitch percentage change is 20% or more, no pitch interpolation is performed, and the corresponding output pitch contour array ip(i) contains (20+2.5)*24=540 elements, all of which are equal to 3*PR_Q. (With 24 kHz sampling, there are 540 samples for 22.5 ms of signal.)

If the pitch percentage change is less than 20%, then block 446 performs sample-by-sample linear interpolation between 3*PR_Q of the current frame and that of the last frame. The sample-by-sample linear interpolation is done within the current 20 ms frame at a sampling rate of 24 kHz (20*24=480 samples). Note that PR_Q is considered the pitch period corresponding to the last sample of the current frame (this will be explained in the section titled "Pitch"). The same slope of the straight line used in the linear interpolation is then used to do linear extrapolation of the pitch period for the first 2.5 ms (60 samples) of the next frame. Note that such extrapolation can produce extrapolated pitch periods that are outside of the allowed range for the 24 kHz pitch period. Therefore, after the extrapolation, the extrapolated pitch period is checked to see if it exceeds the range. If it does, it is clipped to the maximum or minimum allowed pitch period for 24 kHz to bring it back into the range.

B.3 Determination of Baseband LPC Predictor Coefficients and Baseband LPC Residual Subframe Gains In FIG. 4, block 410 derives the baseband LPC predictor coefficient array A and the baseband LPC residual subframe gain array SFG from the quantized 8 kHz fullband LSF array LSF_Q and the quantized fullband LPC residual frame gain FRG_Q. FIG. 4.1 shows a detailed block diagram of block 410.

Refer to FIG. 4.1. An LPC order of 10 is used for the fullband LPC analysis. Block 411 converts the 10-dimensional quantized fullband LSF vector LSF_Q to the fullband LPC predictor coefficient array AF. The procedures for such a conversion is well known in the art. The output is AF={AF(0), AF(1), AF(2), . . . , AF(10)}, where AF(0)=1.

The functions of blocks 412 through 415 can be implemented in a number of different ways that are mathematically equivalent. One preferred implementation is described below. Block 412 computes the log magnitude spectrum of the frequency response of the LPC synthesis filter represented by AF. The AF vector is padded with zeroes to form a vector AF' whose length is sufficiently long and is a power of two. The minimum size recommended for this zero-padded vector is 128, but the size can also be 256 or 512, if higher frequency resolution is desired and the computational complexity is not a problem. Assume that the size of 512 is used. Then, a 512-point FFT is performed on the 512-dimensional zero-padded vector AF'. This gives 257 frequency samples from 0 to 4 kHz. Since we are only interested in the 0 to 2 kHz baseband, we take only the first 129 points (0 to 2 kHz), compute the power by adding the squares of the real part and the imaginary part, take base-2 logarithm of the power values, and negate the resulting logarithmic values. The resulting 129-dimensional vector AM represents the 0 to 2 kHz baseband portion of the base-2 logarithmic magnitude response of the fullband LPC synthesis filter represented by AF.

Block 413 simulates the effects of the high pass filter in block 442 and the low pass filter in block 452 on the baseband signal magnitude spectrum. The base-2 logarithmic magnitude responses of these two fixed filters in the frequency range of 0 to 2 kHz are pre-computed using the same frequency resolution as in the 512-point FFT mentioned above. The resulting two 129-dimensional vectors of baseband log2 magnitude responses of the two filters are stored. Block 413 simply adds these two stored log2 magnitude responses to AM to give the corresponding output vector CAM. Thus, the output vector CAM follows AM closely except that the frequency components near 0 Hz and 2 kHz are attenuated according to the frequency responses of the high pass filter in block 442 and the low pass filter in block 452.

Block 414 takes the quantized fullband LPC residual frame gain FRG_Q, which is already expressed in the log2 domain, and just adds that value to every component of CAM. Such addition is equivalent to multiplication, or scaling, in the linear domain. The corresponding output SAM is the scaled baseband log2 magnitude spectrum.

Block 415 individually performs the inverse function of the base-2 logarithm on each component of SAM. The resulting 129-dimensional vector PS' is a power spectrum of the 0 to 2 Hz baseband that should provide a reasonable approximation to the spectral envelope of the baseband signal s(n). To make it a legitimate power spectrum, however, block 415 needs to create a 256-dimensional vector PS that has the symmetry of a Discrete Fourier Transform output. This output vector PS is determined as follows:

$$PS(j) = \begin{cases} PS'(j), & j = 0, 1, 2, \ldots, 128 \\ PS'(256 - j), & j = 129, 130, \ldots, 255 \end{cases}$$

Block 416 performs a 256-point inverse FFT on the vector PS. The result is an auto-correlation finction that should approximate the auto-correlation finction of the time-domain 4 kHz baseband signal s(n). In the preferred embodiment, an LPC order of 6 is used for the 4 kHz baseband signal s(n). Therefore, RBB, the output vector of block 416, is taken as the first 7 elements of the inverse FFT of PS.

Block 417 first converts the input auto-correlation coefficient array RBB to a baseband LPC predictor coefficient array A' using Levinson-Durbin recursion, which is well known in the art. This A' array is obtained once a frame. However, it is well known in the CELP coding literature that for best speech quality, the LPC predictor coefficients should be updated once a subframe. In the preferred embodiment, the fullband LPC predictor is derived from a set of Discrete Fourier Transform coefficients obtained with an analysis window centered at the middle of the last subframe of the current frame. Hence, the array A' already represents the required baseband LPC predictor coefficients for the last subframe of the current frame. It is necessary to get an interpolated version of A' for the other subframe(s). (In the preferred embodiment described here, there is only one other subframe in the current frame, but in general there could be more subframes.) It is well known in the art that the Line Spectrum Frequency (LSF) parameter set is well suited for interpolating LPC coefficients. Therefore, block 417 converts A' to a 6-dimensional LSF vector, perform subframe-by-subfrarne linear interpolation of this LSF vector with the corresponding LSF vector of the last frame, and then converts the interpolated LSF vectors back to LPC predictor coefficients for each subframe. It should be noted that the output vector A of block 417 contains multiple sets of interpolated baseband LPC predictor coefficients, one set for each subframe.

Another output of block 417 is EBB, the baseband LPC prediction residual energy. This scalar value EBB is obtained as a by-product of the Levinson-Durbin recursion in block 417. Those skilled in the art should know how to get such an LPC prediction residual energy value from Levinson-Durbin recursion.

Block 418 converts EBB to base-2 logarithm of the RMS value of the baseband LPC prediction residual. Theoretically, EBB is the energy of the LPC prediction residual of a baseband signal that is weighted by the LPC analysis window. To get the root-mean-square (RMS) value of the prediction residual, normally we should divide EBB by the energy of the LPC analysis window and take the square root of the result. Here, a conventional time-domain LPC analysis was not performed. Instead, the baseband LPC predictor and EBB are indirectly derived from a full-band LPC predictor, which is itself obtained from frequency-domain LPC modelling. In this case, to get the base-2 logarithmic RMS value of the baseband LPC prediction residual, EBB is divided by half the energy of the analysis window used in the spectral estimation block 120, take base-2 logarithm of the quotient, and multiply the result by 0.5. (This multiply by 0.5 operation in the log domain is equivalent to the square root operation in the linear domain.) The result of such operations is the output of block 418, LGBB, which is the base-2 logarithmic RMS value of the baseband LPC prediction residual. Note that LGBB is computed once a frame.

Block 419 performs subframe-by-subframe linear interpolation between the LGBB of the current frame and the LGBB of the last frame. Then, it applies the inverse finction of the base-2 logarithm to the interpolated LGBB to convert the logarithmic LPC residual subframe gains to the linear domain. The resulttin output vector SFG contains one such linear-domain baseband LPC residual subframe gain for each subframe.

If the presently disclosed RCELP codec is used as a stand-alone full-band codec, then FIG. 4.1 will be greatly simplified. All the special processing to obtain the baseband LPC predictor coefficients and the baseband LPC residual gains can be eliminated. In a stand-alone full-band RCELP codec, the LSF quantization will be done inside the codec. The output LPC predictor coefficients A is directly obtained as AF. The output SFG is obtained by taking base-2 logarithm of FRG_Q, interpolate for each subframe, and convert to the linear domain.

B.4 Generalized Analysis by Synthesis (GABS) Pre-processing

FIG. 4.2 shows a detailed block diagram for the GABS pre-processing block 420. Although the general concept in generalized analysis by synthesis and RCELP is prior art, there are several novel features in the GABS pre-processing block 420 of the hybrid codec of present invention.

Referring to FIG. 4.2, block 421 takes the pitch estimate P from the harmonic encoder, opens a search window around P, and refines the pitch period by searching within the search window for an optimal time lag PR0 that maximizes a normalized correlation function of the high pass filtered 8 kHz fullband signal shp(m). Block 421 also calculates the pitch prediction gain PPG corresponding to this refined pitch period PR0. This pitch prediction gain is later used by the GABS control module block 422.

The floating-point values of 0.9*P and 1.1*P are rounded off to their nearest integers and clipped to the maximum or minimum allowable pitch period if they ever exceed the allowed pitch period range. Let the resulting pitch search range be [P1, P2]. The pitch estimate P is rounded off to its nearest integer RP, and then used as the pitch analysis window size. The pitch analysis window is centered at the end of the current frame. Hence, the analysis window extends about half a pitch period beyond the end of the current frame. If half the pitch period is greater than the so-called "look-ahead" of the RCELP encoder, the pitch analysis window size is set to twice the look-ahead value and the window is still centered at the end of the current frame.

Let n1 and n2 be the starting index and ending index of the adaptive pitch analysis window described above, respectively. The following normalized correlation function is calculated for each lag j in the pitch period search range [P1, P2].

$$f(j) = \frac{\sum_{m=n1}^{n2} \mathrm{shp}(m)\mathrm{shp}(m-j)}{\sum_{m=n1}^{n2} \mathrm{shp}(m-j)\mathrm{shp}(m-j)}, \quad j = P1, P1+1, \ldots, P2.$$

Next, the normalized correlation function f(j) is up-sampled by a factor of 3. One way to do it is to insert two zeroes between each pair of adjacent samples of f(j), and then pass the resulting sequence through a low pass filter. In this case a few extra samples of f(j) at both ends of the pitch search range need to be calculated. The number of extra samples depends on the order of the low pass filter used. Let fi(i) be the up-sampled, or interpolated version of f(j), where i=3*P1, 3*P1+1, 3*P1+2, . . . , 3*P2. The index i0 that maximizes fi(i) is identified. The refined pitch period PR0 is i0/3, expressed in number of 8 kHz samples. Note that the refined pitch period PR0 may have a fractional value. The pitch period resolution is ⅓ sample at 8 kHz sampling, or 1 sample at 24 kHz sampling.

The pitch prediction gain corresponding to PR0 is calculated as follows. The refined pitch period PR0 of the current frame is compared with PR0', the refine pitch period of the last frame. If the relative change is less than 20%, a linear interpolation between PR0' and PR0 is performed for every 8 kHz sample in the current frame. Each sample of the interpolated pitch contour is then rounded off to the nearest integer. (Note that since the adaptive pitch analysis window is centered at the last sample of the current frame, PR0 is precisely the pitch period at the last sample of the current frame in a time-varying pitch contour.) If the relative change from PR0' to PR0 is greater than or equal to 20%, then every sample of the interpolated pitch contour is set to the integer nearest to PR0.

Let the resulting interpolated pitch contour be ipc(m), where m=0, 1, 2, . . . , 159 corresponds to the index range for the current 20 ms frame of 8 kHz samples. Then, the pitch prediction gain (in dB) is calculated as $$PPG = -10\log10\left(1 - \frac{\left(\sum_{m=0}^{159} \mathrm{shp}(m)\mathrm{shp}(m-ipc(m))\right)^2}{\sum_{m=0}^{159} \mathrm{shp}(m)\mathrm{shp}(m) \sum_{m=0}^{159} \mathrm{shp}(m-ipc(m))\mathrm{shp}(m-ipc(m))}\right)$$

The GABS control module 422 controls the overall operation of the GABS pre-processor block 420. It determines whether a relative time shift should be performed on the current frame of the output signal sm(n). It signals this decision by the flag GABS_flag. If a time shift should be performed, GABS_flag=1; otherwise, GABS_flag=0. When appropriate, it also resets an output segment pointer SSO1 to bring the GABS-induced delay in sm(n) back to zero.

In addition, block 422 determines whether the refined pitch period PR0 should be biased (modified), and if so, how much bias should be applied to PR0 so the time asynchrony between the input baseband signal s(n) and the GABS-modified output baseband signal sm(n) does not exceed 3 ms. The result of such decisions is reflected in the output refined and modified pitch period PR. This pitch-biasing scheme uses a 3-state finite-state machine similar to the one proposed in W. B. Kleijn, P. Kroon, L. Cellario, and D. Sereno, "A 5.85 kb/s CELP algorithm for cellular applications," in Proceedings of IEEE International Conference on Acoustic, Speech, and Signal Processing (ICASSP), Minneapolis, Minn., U.S.A., 1993, pp. II-596 to II-599.

To perform all these tasks, block 422 relies on a great deal of decision logic. The operation of block 422 is shown as a software flow chart in FIG. 4.2.1. First, the maximum sample magnitude of s(n) within the current frame is identified, at step 10. Let the value be maxmag. At step 12, if maxmag is greater than a magnitude envelope value updated at the last frame, called magenv, then magenv is reset to maxmag at step 14; otherwise, magenv is attenuated by a factor of 255/256 at step 16. Assuming the input original signal os(m) has the dynamic range of 16-bit linear PCM representation, then, when the codec starts up, the value of magenv is initialized to 5000.

At step 18, after the value of magenv is determined, it is decided whether the current frame of speech is in the silence region between talk spurts (the condition maxmag<0.01*magenv), or if it is in the region of low-energy signal which has a very low pitch prediction gain, and therefore is likely to be unvoiced speech (the condition). If either of these two conditions is true, the following four operations are performed at step 30; (1) Disable any GABS pre-processor time shift operation, by setting GABS_flag to zero; (2) Reset GABS_state, the state of the 3-state finite-state machine mentioned above, to zero (neutral state); (3) Set PR=PR0; (4) Reset SSO1, the output shift segment pointer for the original unshifted LPC prediction residual, to NPR+SSM, where NPR is the number of previous LPC prediction residual samples before the current frame that are stored in the buffer of the original unshifted LPC residual, and SSM is the shift segment pointer for the shifted LPC prediction residual. Later in the description of the alignment processor block 425, it will become clear that setting SSO1=NPR+SSM has the effect of synchronizing s(n) and sm(n) and thus bring the GABS-induced delay back to zero.

In accordance with the teachings of the present invention, an attempt is made to control the time asynchrony between s(n) and sm(n) so that it never exceeds 3 ms. If SSO1 is never reset to bring the time asynchrony back to zero from time to time, the amount of time asynchrony would have a tendency to drift to a large value. However, resetting SSO1 to NPR+SSM will generally cause a discontinuity in the output waveform and may be perceived as an audible click. Therefore, SSO1 is reset only when the input signal is in a silence or unvoiced region, since a waveform discontinuity is generally inaudible during silence or unvoiced speech.

At the trailing edge of a block of consecutive frames with GABS_flag=1, that is, when GABS_flag is about to change from 1 to 0, a hangover of one frame is implemented. This hangover avoids the occasional situation where an isolated frame with GABS_flag=0 is in the middle of a stream of frame with GABS_flag=0. The decision logic around the lower left corner of FIG. 4.2.1 implements this 1-frame hangover. The hangover counter variable hoc counts the number of frames the current frame has gone into the hangover period.

If none of the two conditions maxmag<0.01*magenv and maxmag<0.1*magenv and PPG<0.2 is true, the pitch prediction gain PPG is checked to see if it is less than 1.3 dB at step 32. If so, the same hangover decision logic is performed, and if the current frame is beyond the hangover period, we set GABS_flag=0 and PR=PR0, at step 30. The pointer SSO1 is not reset in this case, because the resulting waveform discontinuity may be audible. If PPG is 1.3 dB or more, the current frame is considered to have sufficient periodicity to perform the GABS time shift waveform alignment operation. In this case, the hangover counter hoc is reset to zero at step 44, and the program control proceeds to the next steps of setting GABS_flag=1, at step 48 and calculating delay=(SSM+NPR−SSO)/24, at step 50, which is the delay of sm(n) relative to s(n) expressed in terms of milliseconds. To get the delay in milliseconds, the difference in pointer values is divided by 24 because these pointers refer to 24 kHz sampled signals. A negative value of delay indicates that the output signal sm(n) is ahead of the input s(n).

The right half of FIG. 4.2.1 implements a slightly modified version of the three-state finite-state machine proposed by W. B. Kleijn, et al. The states a, b, and c in that paper are now states 0, −1, and 1, respectively. If sm(n) is ahead of s(n) by more than 1 ms, GABS_state is set to −1, and the pitch period is reduced to slow down the waveform sm(n), until sm(n) is lagging behind s(n), at which point GABS_state is reset to the neutral value of 0. Similarly, if sm(n) is lagging behind s(n) by more than 1 ms, GABS_state is set to 1, and the pitch period is increased to allow sm(n) to catch up with s(n) until sm(n) is ahead of s(n), at which point GABS_state is reset to the neutral value of 0.

One change to the scheme proposed in W. B. Kleijn et al. is in the pitch biasing operation around the lower right corner of FIG. 4.2.1. In the currently disclosed codec, the pitch bias is not achieved by adding or subtracting a constant pitch offset value, as proposed by W. B. Kleijne et al. Instead, the pitch period is increased or decreased by 2%, and then rounded off to the nearest ⅓ sample (for 8 kHz sampling). Sometimes the rounding operation will undo the pitch scaling and make PR equal to PR0. This happens if the minimum allowable pitch is very small, or if the percentage increment or decrement in the pitch period is chosen to be even lower than 2%. When this happens, the pitch period PR is forced to be ⅓ sample higher or lower, depending on the direction of the pitch biasing. This completes the description of the GABS control module block 422.

Referring again to FIG. 4.2. The tasks within blocks 421 and 422 are performed once a frame. The tasks within the other 5 blocks (423 through 427) are performed once a subframe. As previously described, the refined and possibly modified pitch period PR from block 422 is quantized to 8 bits, multiplied by 3 to get 24 kHz pitch period, and sample-by-sample linearly interpolated at 24 kHz for the current frame and linearly extrapolated for the first 2.5 ms of the next frame. The resulting interpolated pitch contour at 24 kHz sampling rate, denoted as ip(i), i=0, 1, 2, . . . , 539, is used by the GABS target vector generator block 423 to generate the GABS target vector gt(i), I=0, 1, 2, . . . , 299 at 24 kHz sampling for the current subframe. Again, in addition to the current subframe of 240 samples at 24 kHz, 60 extra samples (2.5 ms at 24 kHz sampling) of gt(i) at the beginning of the next subframe are computed for block 425.

The GABS target vector generator 423 generates gt(i) by extrapolating the last pitch cycle waveform of alpri(i), the aligned version of the 24 kHz interpolated baseband LPC prediction residual. The extrapolation is done by repeating the last pitch cycle waveform of alpri(i) at a pitch period defined by the interpolated pitch contour ip(i). Specifically, $$alpri(i)=alpri(i-ip(i)),\ i=0,1,2,\ldots,299.$$

Here it is assumed that the time indices 0 to 239 correspond to the current subframe, indices 240 to 299 correspond to the first 2.5 ms of the next subframe, and negative indices correspond to previous subframes.

After alpr(i) are assigned, they are copied to the gt(i) array as follows:

$$gt(i)=alpri(i),\ i=0,1,2,\ldots,299.$$

It is noted that due to the way the GABS target signal gt(i) is generated, gt(i) will have a pitch period contour that exactly follows the linearly interpolated pitch contour ip(i). It is also noted that the values of alpri(0) to alpri(299) computed above are temporary and will later be overwritten by the alignment processor 425.

In a conventional RCELP codec as described in by W. B. Kleijn, et al. the quantized excitation signal u(n) in FIG. 4 is used to generate the adaptive codebook vector v(n), which is also used as the GABS target vector. Although this arrangement makes the GABS pre-processor part of the analysis-by-synthesis coding loop (and thus the name "generalized analysis-by-synthesis"), it has the drawback that at very low encoding bit rates, the coding error in u(n) tends to degrade the performance of the GABS pre-processor. In the exemplary embodiment, the GABS pre-processor 420 is decoupled from the analysis-by-synthesis codebook search of RCELP. In other words, instead of using u(n) to derive the GABS target vector, alpri(i) is used, which is completely determined by the input signal and is not affected by the quantization of the RCELP excitation signal u(n). Such a pre-processor is no longer involved in the analysis-by-synthesis codebook search loop and therefore should not be called generalized analysis-by-synthesis.

Blocks 424 through 427, are now described. Block 424 computes the LPC prediction residual lpri(i). If the input signal in the current frame is voiced with sufficient periodicity, block 425 attempts to align the LPC prediction residual with the GABS target vector gt(i). This is done by aligning (by time shifting) the point with maximum energy concentration within each pitch cycle waveform of the two signals. The point of maximum energy concentration within each pitch cycle is referred to as the "pitch pulse", even if the waveform shape around it does not look like a pulse sometimes. The alignment operation is performed one pitch cycle at a time. Each time a whole consecutive block of samples, called a "shift segment", is shifted by the same number of samples. Normally one shift segment roughly corresponds to one pitch cycle of waveform if the pitch period is much smaller than the subframe size. However, if the pitch period is large, or when the shift segment is near the end of the subframe, it is often only a fraction of the pitch cycle, because taking a whole pitch cycle of waveform would have exceeded the look-ahead allowed in the GABS pre-processor. After the alignment operation is done in block 425, the aligned LPC prediction residual alpri(i) is decimated to 4 kHz and pass the result through an LPC synthesis filter to get the GABS-modified output basband signal sm(n).

In the prior art RCELP codec described W. B. Kleijn et al., no upsampled signal higher than 8 kHz sampling rate is used. In developing the hybrid codec of the present invention it was found that, performing the waveform time alignment operation in block 425 using upsampled signal gives improved perceptual quality of the output signal sm(n) (smoother and fewer artifacts), especially when the RCELP codec encodes a signal with a sampling rate lower than 8 kHz. When encoding baseband signal at 4 kHz (or even 2 kHz), it is especially beneficial to perform the time alignment operation in block 425 using upsampled 24 kHz signal, and then downsample the aligned output 24 kHz signal to 4 kHz.

Block 424 uses the subframe-by-subframe updated baseband LPC predictor coefficients A in a special way to filter the 24 kHz upsampled baseband signal is(i) to get the upsampled, or interpolated, baseband LPC prediction residual signal lpri(i) at 24 kHz. It is determined that if the LPC predictor coefficients are updated at the subframe boundary, as is conventionally done, sometimes there are audible glitches in the output signal sm(n). This is due to some portion of the LPC residual waveform being shifted across the subframe boundary. Because of this, the LPC filter coefficients used to derive this portion of the LPC residual are different from the LPC filter coefficients used later to synthesize the corresponding portion of the output waveform sm(n). This can cause an audible glitch, especially if the LPC filter coefficients change significantly across the subframe boundary.

This problem is solved by forcing the updates of the LPC filter coefficients in blocks 424 and 427 to be synchronized with the boundary of the GABS shift segment that is closest to each subframe boundary. This synchronization is controlled by the shift segment pointers SSO and SSM. The pointer SSO holds the index of the first element in the current shift segment of the original interpolated LPC residual lpri(i), while the pointer SSM holds the index of the first element in the current shift segment of the modified (aligned) interpolated LPC residual alpri(i).

Block 424 also needs to filter the 24 kHz upsampled baseband signal is(i) with a set of LPC filter coefficients A that was derived for the 4 kHz baseband signal s(n). This can be achieved by filtering one 6:1 decimated subset of is(i) samples at a time, and repeat such filtering for all 6 subsets of samples. The resulting 6 sets of 4 kHz LPC prediction residual are interlaced in the proper order to get the 24 kHz upsampled LPC residual lpri(i).

Note that the buffer of lpri(i) needs to contain some samples of the previous subframe immediately prior to the current subframe, because the time shifting operation in block 425 may need to use such samples. As previously mentioned, there are NPR samples from previous subframe stored at the beginning of the lpri(i) array, followed by the samples of the current subframe. The fixed value NPR should be equal to at least the sum of the maximum GABS delay, maximum shift allowed in each shift operation, and half the window length used for calculating maximum energy concentration. In the present exemplar embodiment, NPR is 156. Therefore, lpri(NPR)=lpri(156) corresponds to the first sample of lpri(i) in the current subframe.

With the background above, and assuming the current subframe of is(i) is from i=0 to i=239, then the operation of block 424 can be described as follows.

1. j=0
2. ns=SSO−NPR
3. M=the smallest integer that is equal to or greater than (336−ns)/6.
4. mem=[is(ns+j−36), is(ns+j−30), is(ns+j−24), is(ns+j−18), is(ns+j−12), is(ns+j−6)]

5. ss=[is(ns+j), is(ns+j+6), is(ns+j+12), is(ns+j+18), . . . , is(ns+j+6*(M−1))]
6. Use the mem array as the filter initial memory and the ss array as the input signal, perform all-zero LPC prediction error filtering to get the LPC prediction residual for the sub-sampled signal ss. Let the output signal be slpr(n), n=0, 1, 2, . . . , M−1.
7. Assign lpri(SSO+j+6n)=slpr(n) for n=0, 1, 2, . . . , M−1.
8. j=j+1
9. If j<6, go back to step 1 above; if j=6, the operation of block 424 is completed.

Note that the pointer value SSO used in the algorithm above is the output SSO of the alignment processor block 425 after it completed the processing of the last subframe.

At the beginning of each frame, the GABS control module block 422 produces a pointer SSO1 and a flag GABS_flag. The alignment processor block 425 assigns SSO=SSO1 before it starts to process the first subframe of the current frame. The flag GABS_flag controls whether the alignment processor block 425 should perform any alignment operation. If GABS_flag=0, then the input speech is in silence or unvoiced region or otherwise does not have sufficient degree of waveform periodicity to warrant the GABS alignment operation. In this case, it is better to skip any alignment operation to avoid the tendency for the time asynchrony to build up quickly. Therefore, if GABS_flag=0, block 425 output alpri(i) is determined as follows.

$$alpri(SSM+i)=lpri(SSO+i),\ i=0, 1, 2, \ldots, 239.$$

Since no time shift is performed in this case, the output pointers SSO and SSM do not need to be modified further.

If GABS_flag=1, then the input speech of the current frame is considered to have sufficient degree of waveform periodicity, and block 425 performs the pitch pulse alignment operation.

Before describing the alignment algorithm, certain constants and index ranges must be defined. For each subframe, the input linearly interpolated pitch contour ip(i) and the GABS target vector gt(i) are properly shifted so that the index range i=0, 1, . . . , 239 corresponds to the current subframe. The length of the sliding window used for identifying the point of maximum energy concentration (the pitch pulse) is wpp=13 samples at the 24 kHz sampling rate. We also consider this wpp=13 to be the width of the pitch pulse. Half the width of the pitch pulse is defined as hwpp=6. We define NLPR, the number of samples in the lpri(i) array, to be NPR+subframe size+4 ms look-ahead=156+240+96=492.

The alignment algorithm of block 425 is summarized in the steps below.

1. Compute the maximum allowed time shift for each pitch pulse as maxd=the smallest integer that is greater than or equal to 0.05*ip(120), which is 5% of the pitch period at the middle of the subframe.
2. Compute number of gt(i) samples to use: ngt=subframe size+2*(maxd+hwpp)=240+2*(maxd+6)
3. Compute pitch pulse location limit: ppll=ngt−maxd−hwpp−1=ngt−maxd−7
4. Use a rectangular sliding window of 13 samples, compute the energy of lpri(i) within the window (sum of sample magnitude squares) for window center positions from time index i=SSO to i=NLPR−1−hwpp=NLPR−7. Assign the resulting energy values to the array E(i), i=0, 1, 2, . . . , NLPR−7−SSO. Thus, E(0) is the energy of lpri(i) within the window centered at time index SSO, E(1) is the energy for the window centered at SSO+1, and so on.
5. Set nstart=SSO.
6. Set n1=SSO, and using ip(i) as a guide, set n2 to be the time index that is one pitch period after SSO. If the n2 obtained this way is greater than NLPR−7, then set n2=NLPR−7.
7. Find the maximum energy E(i) within the search range i=n1, n1+1, n1+2, . . . , n2. Denote the corresponding index by nmax. A "pitch pulse" is now considered to be located at i=nmax.
8. If this pitch pulse is beyond the limit, then copy remaining samples of lpri(i) to alpri(i) to fill the rest of the subframe, and terminate the loop by jumping to step 22.
   This is implemented as follows.
   If nmax>SSO+ppll−SSM or nmax>=NLPR−wpp, do the next 5 lines:
   (1) ns=240−SSM=number of samples to copy to fill the current subframe
   (2) if ns>NLPR−SSO, then set ns=NLPR−SSO
   (3) for i=0, 1, 2, . . . , ns−1, assign alpri(SSM+i)=lpri(SSO+i)
   (4) update pointers by setting SSM=SSM+ns and SSO=SSO+ns
   (5) go to step 22.
9. Set n1=nmax+hwpp+1=nmax+7, and using ip(i) as a guide, set n2 to be the time index that is hwpp+1=7 samples before the next pitch pulse location (nmax+pitch period). Again, if the n2 obtained this way is greater than NLPR−7, then set n2=NLPR−7.
10. Find the minimum energy E(i) within the search range i=n1, n1+1, n1+2, . . . , n2. Denote the corresponding index by nmin.
11. Compute the length of the current shift segment: seglen=nmin−SSO+1
12. If seglen>ngt−SSM, then set seglen=ngt−SSM so the correlation operation in step 14 will not go beyond the end of the gt(i) array.
13. Now we are ready to search for the optimal time shift to bring the pitch pulse in lpri(i) into alignment with the pitch pulse in alpri(i). (Note that the alignment is relative to SSO and SSM.) First, determine the appropriate search range by computing n1=SSO−maxd and n2=SSO+maxd. If n2+seglen>NLPR, then set n2=NLPR seglen so the correlation operation in step 14 will not go beyond the end of lpri(i).
14. Within the index search range j=n1, n1+1, n1+2, . . . , n2, find the index j which maximizes the correlation function.

$$cor(j) = \sum_{i=0}^{seglen-1} lpri(j+i)gt(SSM+i)$$

Denote the correlation-maximizing j as jmax.

15. If jmax is not equal to SSO, in other words, if a time shift is necessary to align the pitch pulses, then check how much "alignment gain" this time shift provides when compared with no shift at all. The alignment gain is defined as $$AG = 10\log10\left(\frac{\sum_{i=0}^{seglen-1}[lpri(SSO+i)-gt(SSM+i)]^2}{\sum_{i=0}^{seglen-1}[lpri(jmx+i)-gt(SSM+i)]^2}\right)$$

If the alignment gain AG is less than 1 dB, then we disable the time shift and set jmax=SSO. (This avoids occasional audible glitches due to unnecessary shifts with very low alignment gains.)

16. Calculate delay=SSM+NPR−jmax. If delay>72 or delay<−72, then set jmax=SSO. This places a absolute hard limit of 72 samples, or 3 ms, as the maximum allowed time asynchrony between s(n) and sm(n).
17. Calculate the number of samples the time shift is to the left, as nls=SSO−jmax.
18. Set SSO=jmax=beginning of the shift segment.
19. If nls>0 (time shift is to the left), then set alpri(SSM+i)=0, for i=0, 1, . . . , nls−1, and then set alpri(SSM+i)=lpri(SSO+i), for i=nls, nls+1, . . . , seglen−1; otherwise (if nls<=0), set alpri(SSM+i)=lpri(SSO+i), for i=0, 1, 2, . . . , nls−1. The reason for the special handling of setting alpri(SSM+i)=0, for i=0, 1, . . . , nls−1 when nls>0 is that if we do the normal copying of alpri(SSM+i)=lpri(SSO+i), i=0, 1, . . . , nls−1, then the portion of the waveform lpri(SSO+i), i=0, 1, . . . , nls−1 will be repeated twice in the alpri(i) signal, because this portion is already in the last shift segment of alpri(i). This waveform duplication sometimes causes an audible glitch in the output signal sm(n). It is better to set this portion of the alpri(i) waveform to zero than to have the waveform duplication.
20. Increment the pointers by the segment length, by setting SSO=SSO+seglen and SSM=SSM+seglen.
21. If SSM<240, go back to step 6; otherwise, continue to step 22.
22. If SSM<239, then set alpri(i)=0 for i=SSM, SSM+1, . . . , 239.
23. Decrement pointers by the subframe size to prepare for the next subframe, by setting SSO=SSO−240 and SSM=SSM−240.
24. If SSM<0, set SSM=0.
25. If SSM>=ngt, set SSM=ngt−1.

Once the aligned interpolated linear prediction residual alpri(i) is generated by the alignment processor block 425 using the algorithm summarized above, it is passed to block 423 to update the buffer of previous alpri(i), which is used to generate the GABS target signal gt(i). The signal alpri(i) is also passed to block 426 along with SSM.

Block 426 performs 6:1 decimation of the alpri(i) samples into the baseband aligned LPC residual alpr(n) in such a manner that the sampling phase continues across boundaries of shift segments. (If we always started the downsampling at the first sample of the shift segments corresponding to the current subframe, the down-sampled signal would have waveform discontinuity at the boundaries). Block 426 achieves this "phase-aware" downsampling by making use of the pointer SSM. The value of block 425 output SSM of the last subframe is stored in Block 426. Denote this previous value of SSM as PSSM. Then, the starting index for sub-sampling the alpri(i) signal in the shift segments of the current subframe is calculated as $$ns=6\lceil PSSM/6\rceil$$

That is, PSSM is divided by the down-sampling factor 6. The smallest integer that is greater than or equal to the resulting number is then multiplied by the down-sampling factor 6. The result is the starting index ns. The number of 4 kHz alpr(n) samples in the shift segments of the current subframe is $$nalpr=\left\lceil\frac{240+SSM-ns}{6}\right\rceil$$

The 4 kHz baseband aligned LPC residual is obtained as $$alpr(n)=alpri(ns+6n),\ n=0, 1, 2, \ldots, nalpr-1$$

Block 427 takes alpr(n), SSM, and A as inputs and performs LPC synthesis filtering to get the GABS-modified baseband signal sm(n) at 4 kHz. Again, the updates of the LPC filter coefficients are synchronized to the GABS shift segments. In other words, the change from the LPC filter coefficients of the last subframe to that of the current frame occurs at the shift segment boundary that is closest to the subframe boundary between the last and the current subframe.

Let SSMB be the equivalent of SSM in the 4 kHz baseband domain. The value of SSMB is initialized to 0 before the RCELP encoder starts up. For each subframe, block 427 performs the following LPC synthesis filtering operation.

$$sm(SSMB+n)=\sum_{j=1}^{6}a_j sm(SSMB+n-j)+alpr(n),$$

$$n=0, 1, 2, \ldots, nalpr-1$$

where $[1, -a_1, -a_2, \ldots, -a_6]$ represents the set of baseband LPC filter coefficients for the current subframe that is stored in the baseband LPC coefficient array A.

After such LPC synthesis filtering, the baseband modified signal shift segment pointer SSMB is updated as $$SSMB=SSMB+nalpr-40$$

Where the number 40 represents the subframe size in the 4 kHz baseband domain.

It should be noted that even though the blocks 424 through 427 process signals in a time period synchronized to the shift segments in the current subframe, once the GABS-modified baseband signal sm(n) is obtained, it is processed subframe-by-subframe (from subframe boundary to subframe boundary) by the remaining blocks in FIG. 4 such as block 464. The GABS-shift-segment-synchronized processing is confined to blocks 424 through 427 only. This concludes the description of the GABS-preprocessor block 420.

B.5 Perceptual Weighting Filtering

Referring again back to FIG. 4. Block 460 derives the short-term perceptual weighting filter coefficients aw and bw from the baseband LPC filter coefficient A as follows. for j=1, 2, 3, . . . , 6.

$$aw_j=(0.6)^j a_j$$

$$bw_j=(0.94)^j a_j$$

The short-term perceptual weighting filter block 464 filters the GABS-modified baseband signal sm(n) to produce the short-term weighted modified signal smsw(n). For the current subframe of n=0, 1, 2, . . . , 39, the filter output smsw(n) is calculated as $$smsw(n)=sm(n)-\sum_{j=1}^{6}bw_j sm(n-j)+\sum_{j=1}^{6}aw_j smsw(n-j)$$

Block 448 finds the integer pitch period that is closest to the sample of the interpolated pitch period contour ip(i) at the center of the current subframe. This integer pitch period, called LAG, is then used by blocks 462, 430, and 484 where a fixed integer pitch period for the whole subframe is required. Recall that both the sample value and the indexing of ip(i) are expressed in $$LAG = round\left(\frac{ip(120)}{6}\right)$$

24 kHz samples. Hence, index 120 corresponds to the center of the current subframe, and ip(120)/6 corresponds to the pitch period at the center of the current subframe, expressed in number of 4 kHz samples. Rounding off ip(120)/6 to the nearest integer gives the desired output value of LAG.

The long-term perceptual weighting filter block 466 and its parameter adaptation is similar to the harmonic noise shaping filter described in the ITU-T Recommendation G.723.1 Block 462 determines the parameters of the long-term perceptual weighting filter using LAG and smsw(n), the output of the short-term perceptual weighting filter. It first searches around the neighborhood of LAG to find a lag PPW that maximizes a normalized correlation finction of the signal smsq(n), and then determines a single-tap long-term perceptual weighting filter coefficient PWFC. The procedure is summarized below.

1. Set n1=largest integer smaller than or equal to 0.9*LAG.
2. If n1<MINPP, set n1=MINPP, where MINPP is the minimum allowed pitch period expressed in number of 4 kHz samples.
3. Set n2=smallest integer greater than or equal to 1.1*LAG.
4. If n2>MAXPP, set n2=MAXPP, where MAXPP is the minimum allowed pitch period expressed in number of 4 kHz samples.
5. For j=n1, n1+1, n1+2, . . . , n2, calculate $$nc(j) = \frac{\left[\sum_{n=n1}^{n2} smsw(n)smsw(n-j)\right]^2}{\sum_{n=n1}^{n2} smsw(n-j)smsw(n-j)}$$

6. Find the index j that maximizes nc(j), then set PPW to the value of this j.
7. Calculate $$G_{opt} = \frac{\sum_{n=n1}^{n2} smsw(n)smsw(n-PPW)}{\sum_{n=n1}^{n2} smsw(n-PPW)smsw(n-PPW)}$$

and limit the result to the range of [0,1].

8. Calculate $$E = \sum_{n=n1}^{n2} smsw^2(n).$$

$smsw^2(n)$.

9. Calculate $$PWFC = \begin{cases} 0.3125G_{opt}, & \text{if } -10\log_{10}\left(1-\frac{nc(PPW)}{E}\right) > 2 \\ 0, & \text{otherwise} \end{cases}$$

Block 466 performs the long-term perceptual weighting filtering operation. For the current subframe index range of n=0, 1, 2 . . . , 39, the output signal smw(n) is calculated as $$smw(n)=smsw(n)-PWFC*smsw(n-PPW)$$

B.6 Impulse Response Calculation

Block 472 calculates the impulse response of the perceptually weighted LPC synthesis filter. Only the first 40 samples (the subframe length) of the impulse response are calculated. The LPC synthesis filter has a transfer function of 1/A(z), where $$A(z) = 1 - \sum_{j=1}^{6} a_j z^{-j}$$

The cascaded short-term perceptual weighting filter and long-term perceptual weighting filter has a transfer function of $$W(z) = \frac{1 - \sum_{j=1}^{6} bw_j z^{-j}}{1 - \sum_{j=1}^{6} aw_j z^{-j}}(1 - PWFC * z^{-PPW}).$$

The perceptually weighted LPC synthesis filter, which is a cascade of the LPC synthesis filter, the short-term perceptual weighting filter, and the long-term perceptual weighting filter, has a transfer function of $$H(z) = \frac{W(z)}{A(z)}.$$

With all filter memory of H(z) initialized to zero, passing a 40-dimensional impulse vector [1, 0, 0, . . . , 0] through the filter H(z) produces the desired impulse response vector h(n), n=0, 1, 2, . . . , 39.

B.7 Zero-Input Response Calculation and Filter Memory Update

Block 468 calculates the zero-input response of the weighted LPC synthesis filter H(z)=W(z)/A(z) and update the filter memory of H(z). Its operation is well known in the CELP literature.

At the beginning of the current subframe, the filter H(z) has a set of initial memory produced by the memory update operation in the last subframe using the quantized excitation u(n). A 40-dimensional zero vector is filtered by the filter H(z) with the set of initial memory mentioned above. The corresponding filter output is the desired zero-input response vector zir(n), i=0, 1, 2, . . . , 39. The set of non-zero initial filter memory is saved to avoid being overwritten during the filtering operation.

After the quantized excitation vector u(n), n=0, 1, 2, . . . , 39 is calculated for the current subframe (the method for obtaining u(n) is described below), it is used to excite the filter H(z) with the saved set of initial filter memory. At the end of the filtering operation for the 40 samples of u(n), the resulting updated filter memory of H(z) is the set of filter initial memory for the next subframe.

B.8 Adaptive Codebook Target Vector Calculation

The target vector for the adaptive codebook is calculated as x(n)=smw(n)−zir(n).

B.9 Adaptive Codebook Related Processing

The adaptive codebook vector generation block 474 generates the adaptive codebook vector v(n), n=0, 1, 2, . . . , 39 using the last pitch cycle of u(n) in the last frame and the interpolated pitch period contour ip(i). The output adaptive codebook vector v(n) will have a pitch contour as defined by ip(i).

The quantized excitation signal u(n) is used to update a signal buffer pu(n) that stores the signal u(n) in the previous subframes. The pu(n) buffer contains NPU samples, where NPU=MAXPP+L, with MAXPP being the maximum allowed pitch period expressed in number of 4 kHz samples, and L being the number of samples to one side of the poly-phase interpolation filter to be used to interpolate pu(n). In the present exemplary embodiment, L is chosen to be 4. The operation of block 474 is described below.

1. Set firstlag=the largest integer that is smaller than or equal to ip(0)/6, which is the pitch period at the beginning of the current subframe, expressed in terms of number of 4 kHz samples.
2. Set frac=ip(0)−firstlag*6=fractional portion of the pitch period at the beginning of the subframe.
3. Calculate the starting index of pu(n) for interpolation: ns=NPU−firstlag−L.
4. Set lastlag=the largest integer that is smaller than or equal to ip(239)/6, which is the pitch period at the end of the current subframe, expressed in terms of number of 4 kHz samples.
5. Calculate number of 4 kHz samples to extrapolate pu(n) at the beginning of the current subframe: nsam=40+L−lastlag.
6. If nsam>0, it is necessary to extrapolate pu(n) at the beginning of the current subframe, then do the following:
   (1) If nsam>L, set nsam=L.
   (2) Take the sequence of samples from pu(ns) to pu(ns+L+nsam+L), insert 5 zeroes between each pair of adjacent samples, then feed the resulting sequence through a poly-phase interpolation filter covering L=4 samples on each side (the interpolation filter of G.729 can be used here). Denote the resulting signal as ui(i), i=0, 1, 2, . . . , 6(2L+nsam)+1.
   (3) Calculate starting index in ui(i) for extrapolation: is=6L−frac.
   (4) Extrapolate nsam samples of pu(n) at the beginning of the current frame:

$$pu(NPU+n)=ui(is+6n),\ n=0, 1, 2, \ldots, nsam-1.$$

7. Calculate the ending index of pu(n) for interpolation: ne=NPU+40−lastlag+L.
8. If ne>NPU+L, then set ne=NPU+L.
9. Interpolate the samples between pu(ns) and pu(ne) by a factor of 6 using the same procedure as in step 6 (2) above. Denote the resulting interpolated signal as ui(6*ns), ui(6*ns+1), . . . , ui(6*ne). This signal represents the interpolated version of the last pitch cycle (plus 4 samples on each side) of pu(n) in the previous subframes.
10. Extrapolate the 24 kHz interpolated last pitch cycle to fill the current subframe:
    For i=0, 1, 2, . . . , 239, set ui(6*NPU+i)=ui(6*NPU+i−ip(i)).
11. Sub-sample the resulting 24 kHz subframe of ui(i) to get the current 4 kHz subframe of adaptive codebook output vector: For n=0, 1, 2, . . . , 39, set v(n) u(6*NPU+6n).

Block 476 performs convolution between the adaptive codebook vector v(n) and the impulse response vector h(n), and assign the first 40 samples of the output of such convolution to y(n), the H(z) filtered adaptive codebook vector.

Block 478 calculates the unquantized adaptive codebook scaling factor as $$GP=\frac{\sum_{n=0}^{39} x(n)y(n)}{\sum_{n=0}^{39} y^2(n)}$$

The scaling unit 480 multiplies each samples of y(n) by the scaling factor GP. The resulting vector is subtracted from the adaptive codebook target vector x(n) to get the fixed codebook target vector.

$$xp(n)=x(n)-GP*y(n)$$

B.10 Fixed Codebook Related Processing

The fixed codebook search module 430 finds the best combination of the fixed codebook pulse locations and pulse signs that gives the lowest distortion in the perceptually weighted domain. FIG. 4.3 shows a detailed block diagram of block 430.

Referring now to FIG. 4.3. Block 431 performs the so-called "pitch pre-filtering" on the impulse response h(n) using the integer pitch period LAG at the center of the subframe. Let hppf(n), n=0, 1, 2, . . . , 39 be the corresponding output vector. Then, $$hppf(n)=h(n)+\beta*hppf(n-LAG),\ n=0, 1, 2, \ldots, 39.$$

Where β is scaling factor that can be determined in a number of ways. In the preferred embodiment, a constant value of β=1 is used. In the equation above, it is assumed that hppf(n)=0 for n<0. Therefore, if LAG>40, then hppf(n)=h(n), and the pitch prefilter has no effect.

This pitch-prefiltered impulse response hppf(n) and the fixed codebook target vector xp(n) are used by the conventional algebraic fixed codebook search block 432 to find the best pulse position index array PPOS1 and the corresponding best pulse sign array PSIGN1. Several prior-art methods can be used to do this search. In the present invention, the fixed codebook search method of ITU-T Recommendation G.729 is used. The only difference is that due to the bit rate constraint, only three pulses are used rather than four. The three "pulse tracks" are defined as follows. The first pulse can be located only at the time indices that are divisible by 5, i.e., 0, 5, 10, 15, 20, 25, 30, 35. The second pulse can be located only at the time indices that have a remainder of 1 or 2 when divided by 5, i.e., 1, 2, 6, 7, 11, 12, 16, 17, . . . , 36, 37. The third pulse can be located only at the time indices that have a remainder of 3 or 4 when divided by 5, i.e., 3, 4, 8, 9, 13, 14, 18, 19, . . . , 38, 39. Hence, the number of possible pulse positions for the three pulse tracks are 8, 16, and 16, respectively. The locations of the three pulses can thus be encoded by 3, 4, and 4 bits, respectively, for a total of 11 bits. The signs for the three pulses can be encoded by 3 bits. Therefore, 14 bits are used to encode the pulse positions and pulse signs in each subframe.

Block 432 also calculates the perceptually weighted mean-square-error (WMSE) distortion corresponding to the combination of PPOS1 and PSIGN1. This WMSE distortion is denoted as D1. It is well known in the art how this distortion can be calculated.

If the integer pitch period LAG is smaller than or equal to 22, then block 433 is used to perform an alternative fixed codebook search in parallel to block 432. If LAG is greater than 22, then blocks 434 and 435 are used to perform the alternative fixed codebook search in parallel.

Block 433 is a slightly modified version of block 432. The difference is that there are four pulses rather than three, but all four pulses are confined to the first 22 time indices of the 40 time indices in the current 4 kHz subframe. The first pulse track contains the time indices of [0, 4, 8, 12, 16, 20]. The second through the fourth pulse tracks contain the time indices of [1, 5, 9, 13, 17, 21], [2, 6, 10, 14, 18], and [3, 7, 11, 15, 19], respectively. The output vector of this specially structured fixed codebook has no pulses in the time index range 22 through 39. However, as will be discussed later, after this output vector is passed through the pitch pre-filter, the pulses in the time index range [0, 21] will be repeated at later time indices with a repetition period of LAG.

For convenience of discussion, we refer to the pulses identified by the codebook search blocks 432 or 433 as the "primary pulses". In addition, we refer to the pulses that are generated from the primary pulses through the pitch pre-filter as the "secondary pulses". Thus, the conventional algebraic fixed codebook used in block 432 has three primary pulses that may be located throughout the entire time index range of the current subframe. On the other hand, the confined fixed codebook used by block 433 has four primary pulses located in the time index range of [0, 21]. The confined range of [0, 21] is chosen such that the four primary pulses can be encoded at the same bit rate as the three-pulse conventional algebraic fixed codebook used in block 432. The numbers of possible locations for the four pulses are 6, 6, 5, and 5. Hence, the positions of the first and the third pulses can be jointly encoded into 5 bits, since there are only 30 possible combinations of positions. Similarly, the positions of the second and the fourth pulses can be jointly encoded into 5 bits. Four bits are used to encode the signs of the four primary pulses. Therefore, a total of 5+5+4=14 bits per subframe are used to encode the positions and signs of the 4 primary pulses of the confined algebraic fixed codebook used in block 433. This is the same as the bit rate used to encode the positions and signs of the 3 primary pulses of the conventional algebraic fixed codebook used in block 432. When the input signal is highly periodic and has a pitch period less than 22 samples at 4 kHz sampling, this four-pulse confined algebraic fixed codebook tends to achieve better performance than the three-pulse conventional algebraic fixed codebook.

Except for the differences in the number of primary pulses and the range of the allowed pulse locations, block 433 performs the fixed codebook search in exactly the same way as in block 432. The resulting pulse position array, pulse sign array, and the WMSE distortion are PPOS2, PSIGN2, and D2, respectively.

If LAG is greater than 22, then the functions of blocks 434 and 435 are performed. The main difference between block 435 and the previous two codebook search modules 432 and 433 is that block 435 does not use the pitch pre-filter to generate secondary pulses at a constant pitch period of LAG. Instead, it places secondary pulses at a time-varying pitch period from the corresponding primary pulses, where the time-varying pitch period is defined by the interpolated pitch period contour ip(i). This arrangement improves the coding performance of the fixed codebook when the pitch period contour changes significantly within the current subframe.

To perform a fixed codebook search with such an adaptive pitch repetition of secondary pulses, it is convenient to find a mapping that maps any time index in the current subframe to the time index that is one pitch period later as defined by the interpolated pitch period contour ip(i). Given the time index of any primary or secondary pulse, such a mapping gives the time index of the next secondary pulse that is one pitch period later. Block 434 uses the interpolated pitch period contour ip(i) to determine such a mapping, and puts the result in its output "next pulse index" array npi(n), n=0, 1, 2, . . . , 39.

Note that the interpolated pitch period contour is determined in a "backward projection" manner. In other words, at 24 kHz sampling, for a speech waveform sample at the time index i, the waveform sample one pitch period earlier is located at the time index i−ip(i). The next pulse index array npi(n), on the other hand, needs to define a "forward projection", where for a 4 kHz waveform sample at a given time index n, the waveform sample that is one pitch period later, as defined by ip(i), is located at the time index npi(n). It is not obvious how the backward projection defined pitch contour ip(i) can be converted to the forward projection defined next pulse index npi(n). By making use of the fact that ip(i) is obtained by linear interpolation, we have discovered a linear mapping that allows us to map the time index n to npi(n) directly. This method is outlined below. As a convention, if the next secondary pulse one pitch period later is located beyond the current subframe, we set npi(n)=0 to signal this condition to block 435 which uses the npi(n) array.

1. Initialize npi(n)=0, for n=0, 1, 2, . . . , 39.
2. Calculate the pitch period for the 4 kHz baseband signal at the start of the current subframe: pstart=round(ip(0)/6).
3. Calculate the pitch period for the 4 kHz baseband signal at the end of the current subframe: pend=round(ip(234)/6).
4. Calculate the time index of the last sample whose forward pitch projection is still within the current subframe: lastsam=round(39−pend).
5. If lastsam≧0, this last sample falls into the current subframe, then calculate the next pulse index using a linear equation that expresses the next pulse index as a function of the current index, and then round off the result to the nearest integer, as follows:

(1) slope=39/(39+pstart−pend)

(2) b=slope*pstart (3) For n=0, 1, 2, . . . , lastsam, do the following:

$$npi(n)=\text{round}(\text{slope}*n+b)$$

$$\text{if } npi(n)>39, \text{ set } npi(n)=0.$$

It should be noted that npi(n) is used by block 435 not only to generate a single secondary pulse for a given primary pulse, but also to generate more subsequent secondary pulses if the pitch period is small enough. As an example to show how npi(n) is used by block 435, suppose the pitch period goes from 10 to 11 in the current subframe. For a given primary pulse located at n=2, we have npi(2)=12, so a secondary pulse is located at n=12. Then, because npi(12)=22, block 435 places another secondary pulse at n=22. Furthermore, since npi(22)=33, block 435 places yet another secondary pulse at n=33. The next secondary pulse would have been at n=44, which is beyond the current subframe. Therefore, npi(33) is set to zero by block 434. When block 435 finds that npi(33)=0, it stops the process of placing more secondary pulses for the primary pulse located at n=2. All secondary pulses have the same sign as the corresponding primary pulse.

Block 435 uses three primary pulses located in the same pulse tracks as in block 432. For each of the three primary pulses, block 435 generates all subsequent secondary pulses within the current subframe using the next pulse index mapping npi(n), as illustrated in the example above. Then, for each given combination of primary pulse locations and signs, block 435 calculates the WMSE distortion corresponding to the fixed codebook vector that contains all these three primary pulses and all their secondary pulses. The best combination of primary pulse positions and signs that gives the lowest WMSE distortion is chosen. The corresponding primary pulse position array PPOS3, the primary pulse sign array PSIGN3, and the WMSE distortion value D3 constitute the output of block 435.

There are several ways to perform such a codebook search in block 435. The most optimal way is to calculate the WMSE distortion corresponding to all possible combination of all primary pulses. This guarantees that the best possible combination will be found. However, due to the potentially large number of total pulses (primary and secondary), the distortion calculation and thus the overall codebook search procedure has a high complexity. If such a high complexity is a concern, then sub-optimal approaches can be used. For example, rather than jointly optimal exhaustive search mentioned above, one can use a sequential search where only one primary pulse is determined at a time. In its simplest form, this sequential search is just like a multi-stage quantizer, where each stage completely determines the pulse location and sign of one primary pulse before going to the next stage to determine the location and sign of the next primary pulse. The currently disclosed codec uses this simplest form of sequential search in block 435. Alternatively, the coding performance of this scheme can be improved by keeping multiple surviving candidates of the primary pulse at each stage for use in combination with other candidate primary pulses in other stages. The resulting performance and complexity will be somewhere between the jointly optimal exhaustive search and the simplest multi-stage, single-survivor-per-stage search.

Given the above description of the basic ideas behind blocks 432, 433, and 435, those skilled in the art of algebraic fixed codebook search will understand how to implement these three alternative codebook search modules in view of the present disclosure. Hence, we will not describe the implementation details of these three blocks.

Block 436 is a switch that switches between the outputs of blocks 433 and 435, depending on the integer pitch period LAG. If LAG≦22, then PPOS4=PPOS2, PSIGN4=PSIGN2, and D4=D2. If LAG>22, then PPOS4=PPOS3, PSIGN4=PSIGN3, and D4=D3.

Block 437 chooses the winner from two codebook search methods by comparing the WMSE distortion values D1 and D4. If D1≦D4, then PPOS=PPOS1, PSIGN=PSIGN1, and the fixed codebook flag is set to FCB_flag=0, signifying that the conventional fixed codebook is used. On the other hand, if D1>D4, then PPOS=PPOS4, PSIGN=PSIGN4, and the fixed codebook flag is set to FCB_flag=1, signifying that a non-conventional fixed codebook of block 433 or block 435 is used. The decoder can tell which of the two non-conventional fixed codebooks is used by comparing LAG with 22.

Block 438 simply combines the flag FCB_flag and the two arrays PPOS and PSIGN into a single fixed codebook output index array FCBI. This completes the description of the fixed codebook search module 430.

Referring again to FIG. 4. Block 484 uses PPOS, PSIGN, and FCB_flag in the FCBI array to determine where the primary pulses should be located within the current subframe and what their signs should be. Then, the secondary pulses are reconstructed as $$H_{ppf}(z) = \frac{1}{1 - \beta z^{-LAG}}$$

follows. If FCB_flag=1 and LAG>22, then block 484 uses ip(i) to generate npi(n), which is then used to generate all secondary pulses with adaptive pitch repetition, just like block 435. If FCB_flag=0 or LAG≦22, then block 484 passes the vector containing the primary pulses through the pitch pre-filter, which has a transfer finction of As mentioned earlier, in the currently disclosed codec, β is set to 1. Note that the pitch pre-filter has no effect (that is, it will not add any secondary pulse) if LAG is greater than or equal to the subframe size of 40.

After all secondary pulses are added either by the pitch pre-filter or the adaptive pitch repetition method based on npi(n), the resulting vector c(n), n=0, 1, 2, . . . , 39 is the final fixed codebook output vector that contains both primary pulses and secondary pulses.

B.11 Codebook Gain Quantization

The adaptive codebook gain and the fixed codebook gain are jointly quantized using vector quantization (VQ), with the codebook search attempting to minimize in a closed-loop manner the WMSE distortion of reconstructed speech waveform. To perform such a closed-loop codebook search, the fixed codebook output vector c(n) needs to be convolved with h(n), the impulse response of the weighted LPC synthesis filter H(z). Block 486 performs this convolution and retains only the first 40 samples of the output. The resulting 40-dimensional vector is called z(n), which is calculated as $$z(n) = \sum_{j=0}^{n} c(j)h(n-j),\ n = 0, 1, 2, \ldots, 39$$

Block 488 performs the codebook gain quantization. When training the gain VQ codebook, the optimal unquantized adaptive codebook gain and fixed codebook gain are calculated first. The unquantized fixed codebook gain is normalized by the interpolated baseband LPC prediction residual gain SFG for the current subframe. The base 2 logarithm of the resulting normalized unquantized fixed codebook gain is calculated. The logarithmic normalized fixed codebook gain is then used by a moving-average (MA) predictor design program to compute the mean value and the coefficients of a fixed $6^{th}$-order MA predictor which predicts the mean-removed logarithmic normalized fixed codebook gain sequence. The $6^{th}$-order MA prediction residual of the mean-removed logarithmic normalized fixed codebook gain is then paired with the corresponding base 2 logarithm of the adaptive codebook gain to form a sequence of 2-dimensional training vectors for training a 7-bit, 2-dimensional gain VQ codebook. Thus, the gain VQ codebook is trained in the log domain.

However, to facilitate the closed-loop codebook search later, all elements in such a log2-based gain VQ codebook are converted to linear domain by taking the inverse log2 function, For convenience of description, denote such a two-dimensional linear domain gain VQ codebook array as gcb(j,k), j=0, 1, 2, . . . , 127, k=0, 1. Let the first column (k=0) corresponds to the adaptive codebook gain, while the second column (k=1) corresponds to the fixed codebook gain.

In the actual encoding operation, block 488 first performs the $6^{th}$-order MA prediction using the previously updated predictor memory and the pre-stored set of 6 fixed predictor coefficients. The predictor output is added to the pre-stored fixed mean value of the base 2 logarithm of normalized fixed codebook gain. The mean-restored predicted value is converted to the linear domain by taking the inverse log2 function. Then, the resulting linear value is multiplied by the linear value of the interpolated baseband LPC prediction residual gain SFG for the current subframe. The resulting value pgc can be considered as a predicted version of the fixed codebook gain and is used to scale gcb(j,1), j=0, 1, 2, . . . , 127. Let gp(j)=gcb(j,0), and gc(j)=pgc*gcb(j,1). Then, block 488 performs the closed-loop codebook search by going through j=0, 1, 2 . . . , 127 and calculating the 128 corresponding WMSE distortion values as follows:

$$D_j = \sum_{n=0}^{39} x^2(n) + gp^2(j)\sum_{n=0}^{39} y^2(n) + gc^2(j)\sum_{n=0}^{39} z^2(n) - 2gp(j)\sum_{n=0}^{39} x(n)y(n) - 2gc(j)\sum_{n=0}^{39} x(n)z(n) + 2gp(j)gc(j)\sum_{n=0}^{39} y(n)z(n)$$

All six summations in the equation above are independent of the index j and therefore can be pre-computed outside of the search loop to save computation. The index j=jmin that minimizes the distortion $D_j$ is identified. Then, block 488 assigns GP_Q=gp(jmin) and GC_Q=gc(jmin). The 7-bit gain quantizer output index GI is set to jmin and is passed to the bit packer and multiplexer to be packed into the RCELP encoder output bit stream. The MA predictor memory is updated by shifting all memory elements by one position, as is well known in the art, and then assigning $\log_2$(GC_Q/pgc) to the most recent memory location.

B.12 Reconstructing Quantized Excitation

The scaling units 490 and 492 scale the adaptive codebook vector v(n) and the fixed codebook vector c(n) with the quantized codebook gains GP_Q and GC_Q, respectively. The adder 494 then sums the two scaled codebook vectors to get the final quantized excitation vector $$u(n)=GP_Q*v(n)+GC_Q*c(n),\ n=0,1,2,\ldots,39$$

As mentioned earlier, this quantized excitation signal is then used to update the filter memory in block 468. This completes the detailed description of the RCELP encoder.

C. Quantization

The model parameters comprising the spectrum LSF, voicing PV, frame gain FRG, pitch PR, fixed-codebook mode, pulse positions and signs, adaptive-codebook gain GP_Q and fixed-codebook gain GC_Q are quantized in Quantizer, Bit Packer, and Multiplexer block 185 of FIG. 1 for transmission through the channel by the methods described in the following subsections.

The following is a brief discussion of the bit allocation in a specific embodiment of the presently disclosed codec at 4.0 kb/s. The bit allocation of the codec in accordance with this preferred embodiment is shown in Table 1. In an attempt to reduce the bit-error sensitivity of the quantization, all quantization tables, except fixed-codebook related tables, are reordered.

TABLE 1

| Parameter | Bit Allocation Subframe 1 | Subframe 2 | Total |
|---|---|---|---|
| Spectrum | | 21 | 21 |
| Voicing Probability | | 2 | 2 |
| Frame Gain | | 5 | 5 |
| Pitch | | 8 | 8 |
| Fixed-codebook mode | 1 | 1 | 2 |
| Fixed-codebook index (3 pulse mode/4 pulse mode) | 11/10 | 11/10 | 22/20 |
| Fixed-codebook sign | 3/4 | 3/4 | 6/8 |

TABLE 1-continued

| Parameter | Bit Allocation Subframe 1 | Subframe 2 | Total |
|---|---|---|---|
| (3 pulse mode/4 pulse mode) Codebook gains | 7 | 7 | 14 |
| Total | | | 80 |

C.1 Spectrum

The LSF are quantized using a Safety Net $4^{th}$ order Moving Average (SN-MA4) scheme. The safety-net quantizer uses a Multi-Stage Vector Quantizer (MSVQ) structure.

The MA prediction residual is also quantized using an MSVQ structure. The bit allocation, model order, and MSVQ structure are given in Table 2 below.

TABLE 2

| Quantizer | Spectral Quantization Bit Allocation Model Order | Structure | Bit Allocation | Total Bits |
|---|---|---|---|---|
| Safety-Net | 10 | MSVQ | 7-7-6 | 20 |
| MA4 | 10 | MSVQ | 7-7-6 | 20 |
| Mode | NA | NA | 1 | 1 |

The total number of bits used for the spectral quantization is 21, including the mode bit. The quantized LSF values are denoted as LSF_Q.

C.2 Voicing

The voicing PV is scalar quantized on a non-linear scale using 2 bits. The quantized voicing is denoted as PV_Q.

C.3 Harmonic Gain

The harmonic gain is quantized in the log domain using a $3^{rd}$ order Moving Average (MA) prediction scheme. The prediction residual is scalar quantized using 5 bits and is denoted as FRG_Q.

C.4 Pitch

The refined pitch period PR is scalar quantized in Quantizer block 185, shown in FIG. 1. The pitch value is in the accuracy of one third of a sample and the range of the pitch value is from 4 to 80 samples (corresponding to the pitch frequency of 50 Hz to 1000 Hz, at 4 kHz sampling rate). The codebook of the pitch values is obtained from a combined curve with linear at low pitch values and logarithmic scale curve at larger pitch values. The joint point of two curves is about at pitch value of 28 (the pitch frequency of 142 Hz). The quantized pitch is PR_Q.

C.5 Fixed-codebook Mode, Pulse Positions and Signs

The RCELP fixed codebook model FCB_flag, primary pulse position array PPOS, and primary pulse sign array PSIGN, have been discussed in the section titled "Fixed Codebook Related Processing."

C.6 RCELP Gain

The quantization of the RCELP adaptive codebook gain and fixed codebook gain is described in detail in the section titled "Codebook Gain Quantization."

III. Detailed Description of Hybrid Decoder

A. RCELP Decoder

Figure 5A:
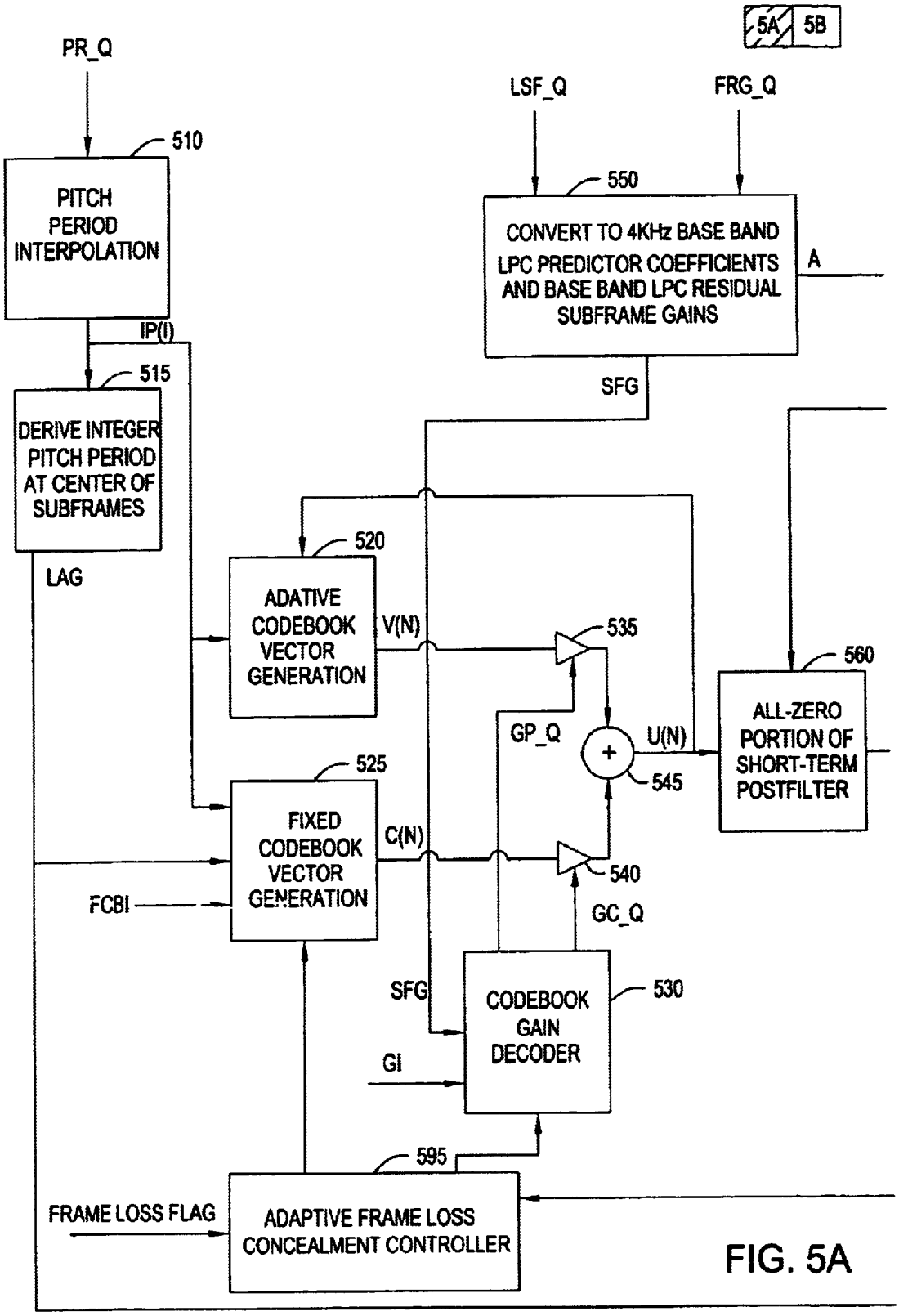
FIG. 5 is a block diagram of an RCELP decoder according to the present invention.
Figure 5B:
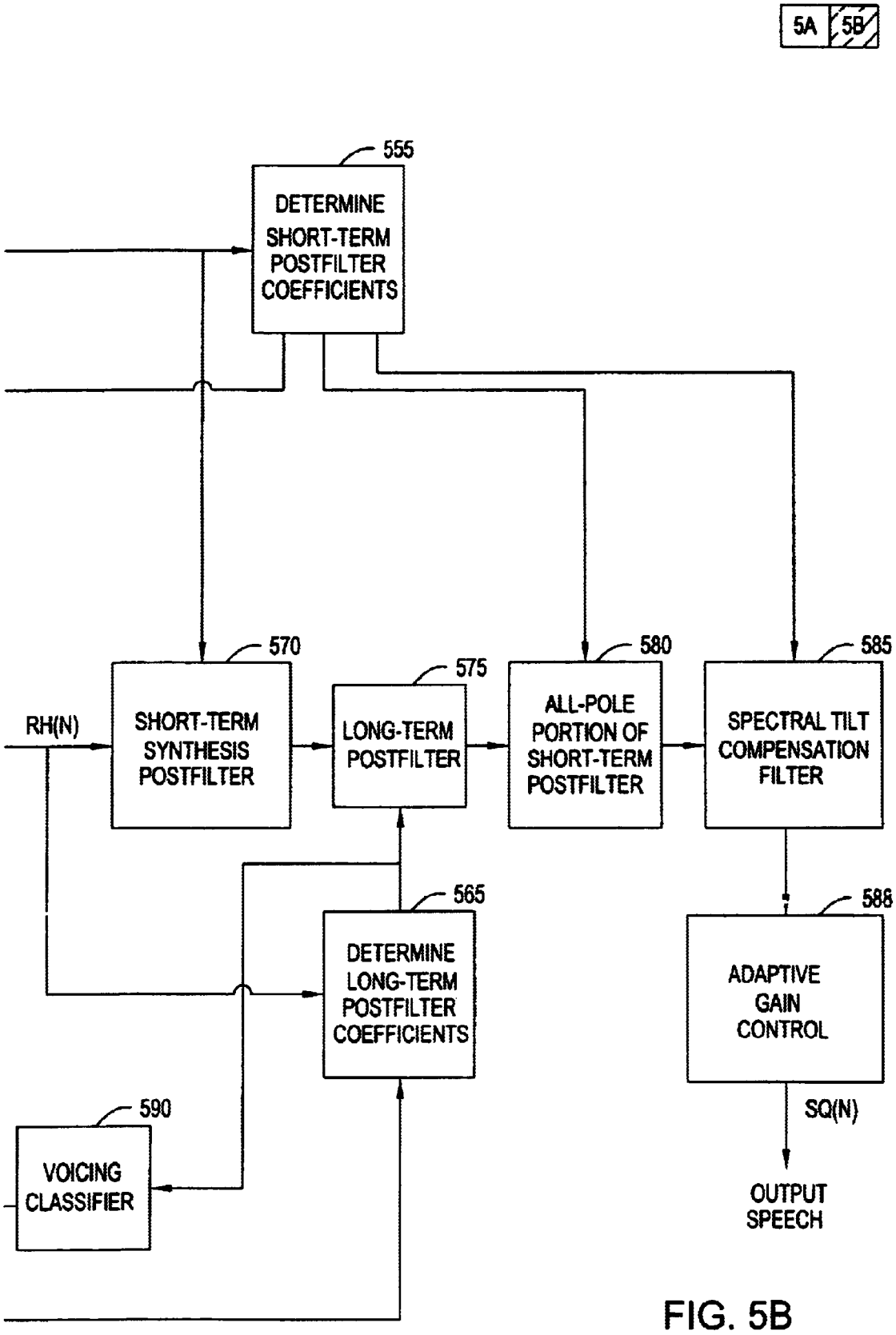

FIG. 5 shows a detailed block diagram of the baseband RCELP decoder, which is a component of the hybrid decoder. The operation of this decoder is described below.

A.1 Deriving Baseband LPC Coefficients and Residual Subframe Gains

Block 550 is functionally identical to block 410. It derives the baseband LPC predictor coefficients A and the baseband LPC residual gain SFG for each subframe.

A.2 Decoding Codebook Gains

The codebook gain decoder block 530 uses the 7-bit received RCELP codebook gain index GI and the subframe baseband LPC residual gain SFG to decode the codebook gains. It performs the same $6^{th}$-order MA prediction, mean addition, inverse log2, and scaling by SFG, exactly the same way as in block 488, to get the predicted fixed codebook gain pgc. Then, the quantized codebook gains are obtained as GP_Q=gcb(GI,0), and GC_Q=pgc*gcb(GI,1).

A.3 Reconstructing Quantized Excitation

Blocks 510 and 515 are functionally identical to blocks 446 and 448, respectively. They generate the interpolated pitch period contour ip(i) and the integer pitch period LAG. Blocks 520 and 525 generate the adaptive codebook vector v(n) and the fixed codebook vector c(n), respectively, in exactly the same way as in blocks 474 and 484, respectively. The scaling units 535 and 540, and the adder 545 performs the same functions as their counterparts 490, 492, and 494 in FIG. 4, respectively. They scale the two codebook output vectors by the appropriate decoded codebook gains and sum the result to get the decoded excitation signal u(n).

A.4 LPC Synthesis Filtering and Adaptive Postfiltering

Blocks 555 through 588 implement the LPC synthesis filtering and adaptive postfiltering. These blocks are essentially identical to their counterparts in the ITU-T Recommendation G.729 decoder, except that the LPC filter order and short-term postfilter order is 6 rather than 10. Since the ITU-T Recommendation G.729 decoder is a well-known prior art, no further details need to be described here.

A.5 Adaptive Frame Loss Concealment

The output of block 565 is used by the voicing classifier block 590 to determine whether the current subframe is considered voiced or unvoiced. The result is passed to the adaptive frame loss concealment controller block.595 to control the operations of the codebook gain decoder 530 and the fixed codebook vector generation block 535. The details of the adaptive frame loss concealment operations are described in the section titled "Adaptive Frame Loss Concealment" below.

B. Hybrid Decoder Interface

B.1 Hybrid Waveform Phase Synchronization

Figure 6:
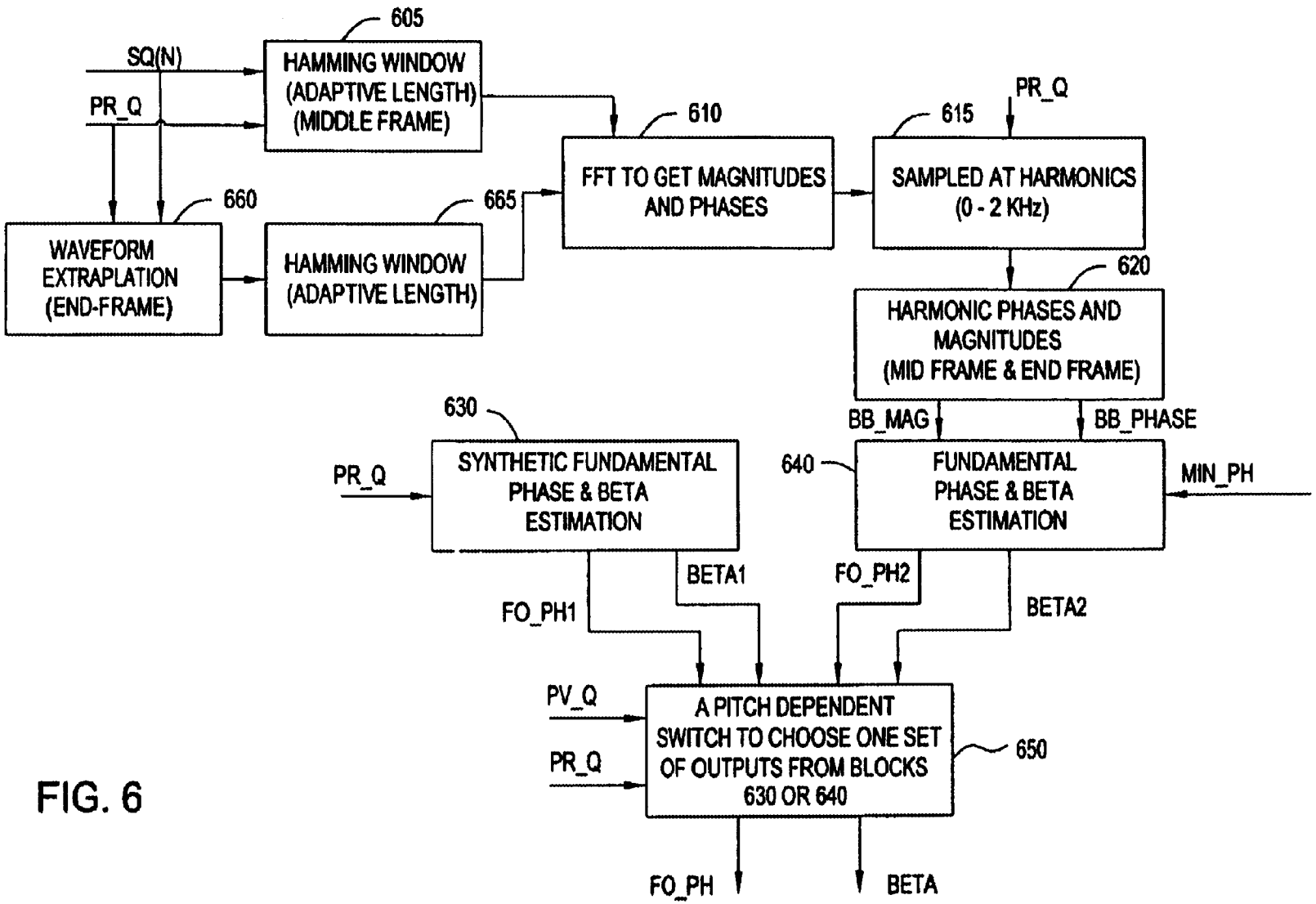
FIG. 6 is a block diagram of block 240 of FIG. 2 of the present invention.

FIG. 6 is a detailed block diagram of the Hybrid Waveform Phase Synchronization block 240 in FIG. 2. Block 240 calculates a fundamental phase F0_PH and a system phase offset BETA, which are used to reconstruct the harmonic high-band signal. The objective is to synchronize waveforms of the base-band RCELP and the high band Harmonic codec.

The inputs to the Hamming Window block 605 are a pitch value PR_Q and a 20 ms baseband time-domain signal sq(n) decoded from the RCELP decoder. Two sets of the fundamental phase and the system phase offset are needed for each 10 ms sub frame. At the first 10 ms frame reference point, called the mid-frame, a hamming window of pitch dependent adaptive length in block 605 is applied to the input base band signal, centered at the 10 ms point of the sequence sq(n). The range of the adaptive window length is predefined between a maximum and a minimum window length.

A real FFT of the windowed signal is taken in block 610. Two vectors, which are BB_PHASE and BB_MAG, are obtained from the Fourier Transform magnitude and phase spectra by sampling them at the pitch harmonics, as indicated in block 615 and block 620. The fundamental phase F0_PH and the system phase offset BETA are then calculated in block 630 and block 640.

The Pitch Dependent Switch block 650 controls the fundamental phase F0_PH and the system phase offset BETA to be exported. When the pitch PR_Q is less than a predefined threshold and the voicing PV_Q is larger than a predefined threshold, the outputs of block 630, F0_PH1 and BETA1, are chosen as the final outputs F0_PH and BETA, respectively. Otherwise, the outputs of block 640, F0_PH2 and BETA2, are selected as the final outputs.

There are two methods to calculate the fundamental phase F0_PH and the system phase offset BETA. One method uses the measured phase from the base band signal and the other method uses synthetic phase projection. The synthetic phase projection method is illustrated in the Synthetic Fundamental Phase & Beta Estimation block 630. In block 630, the system phase offset BETA is equal to the previous BETA, which is bounded between 0 to $2\pi$. The fundamental phase F0_PH is obtained from the previous fundamental phase F0_PH_1, the current pitch period PR_Q and the previous pitch period PR_Q_1, represented by the following equation:

$$\mathrm{F0_PH} = \mathrm{F0_PH_1} + \pi \cdot N \cdot \left(\frac{1}{\mathrm{PR_Q}} + \frac{1}{\mathrm{PR_Q_1}}\right)$$

where N is the subframe length, which is 40 at 4 kHz sampling.

The measured phase method to derive the fundamental phase and the system phase offset is shown in the Fundamental Phase & Beta Estimation block 640. As known in the art, three inputs are needed for this method to calculate the fundamental phase F0_PH and the system phase offset BETA, which are two vectors, BB_PHASE and BB_MAG, obtained earlier, and a third vector called MIN_PH, obtained from the harmonic decoder.

There is not enough base band RCELP signal available for applying a window centered at the end of the sequence sq(n). A waveform extrapolation technique in the Waveform Extrapolation block 660 is applied to extend the sequence sq(n) in order to derive the second set of BB_PHASE and BB_MAG vectors.

The waveform extrapolation method extends the waveform by repeating the last pitch cycle of the available waveform. The extrapolation is performed in the same way as in the adaptive codebook vector generation block 474 in FIG. 4. After the waveform extrapolation, a Hamming window of pitch dependent adaptive length in the Hamming Window block 665 is applied to this base band signal, centered at the end of the sequence sq(n). The range of the adaptive window length is predefined between a maximum and a minimum window length. The maximum window length for the mid frame and the end of frame is slightly different. The procedures for calculating F0_PH and BETA for the mid frame and the end of frame are identical.

B.2 Hybrid Temporal Smoothing

Figure 7:
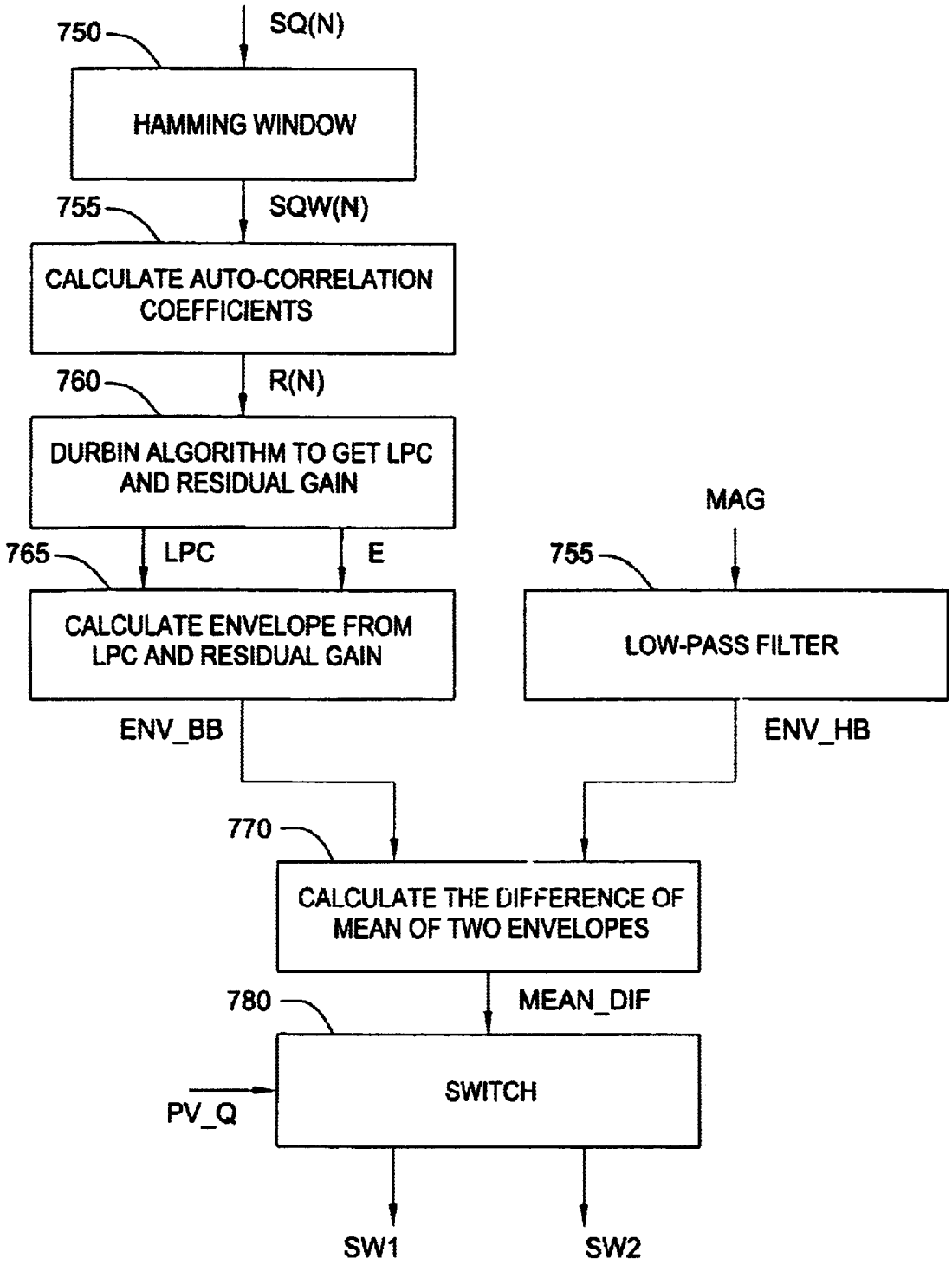
FIG. 7 is a block diagram of block 270 of FIG. 2 of the present invention.

The Hybrid Temporal Smoothing algorithm is used in block 270 of FIG. 2. Details of this algorithm are shown in FIG. 7. The Hamming Window block 750 windows the RCELP decoded base-band signal sq(n). The windowed base-band signal sqw(n) is used by the Calculate Auto Correlation Coefficients block 755 to calculate the autocorrelation coefficients, r(n). These coefficients are passed to block 760, where the Durbin algorithm is used to compute LPC coefficients and residual gain E. Based on the input LPC coefficients and residual gain, block 765 calculates the base-band signal log-envelope denoted by ENV_BB.

The Low-pass filter block 775 applies the RCELP encoder low-pass filter (used in block 135, FIG. 1) envelope to the mid-frame spectral envelope, MAG. The output ENV_HB is fed to block 770, which also gets as its input base-band signal log-envelope, ENV_BB. Block 770 calculates the mean of the difference between the two input envelopes, MEAN_DIF. The MEAN_DIF, is used by Switch block 780 along with voicing PV_Q to determine the settings of the switches SW1 and SW2. If PV_Q<0.1 and either 0.74<MEAN_DIF or MEAN_DIF<−1.2 switches SW1 and SW2 are set to TRUE, otherwise they are set to FALSE. SW1and SW2 are used by block 260 and block 265 of FIG. 2, respectively.

B.3 Sub-band LPF/Resample RCELP Waveform

Details of block 265 used in FIG. 2 are shown in FIG. 8A and described in this section. The finction of this block is to up-sample the RCELP decoded signal sq(n) at 4 kHz to an 8 kHz sampled signal usq(m). The SW2 setting determines the low-pass filter used during the resampling process. There are two low-pass filters, both are $48^{th}$ order linear-phase FIR filters with cutoff frequencies lower than the cutoff frequency of the low-pass filter used in RCELP encoder (block 135, FIG. 1). A low-pass filter with cutoff frequency of 1.7 kHz is employed in block 805 and a second LPF with a cutoff frequency of 650 Hz is employed in block 810. If SW2 is TRUE, block 815 selects the output of block 810 to become the output of block 265, otherwise the output of block 805 is selected to be the output of block 265.

B.4 Subband HPF Harmonic Waveform

Figure 8:
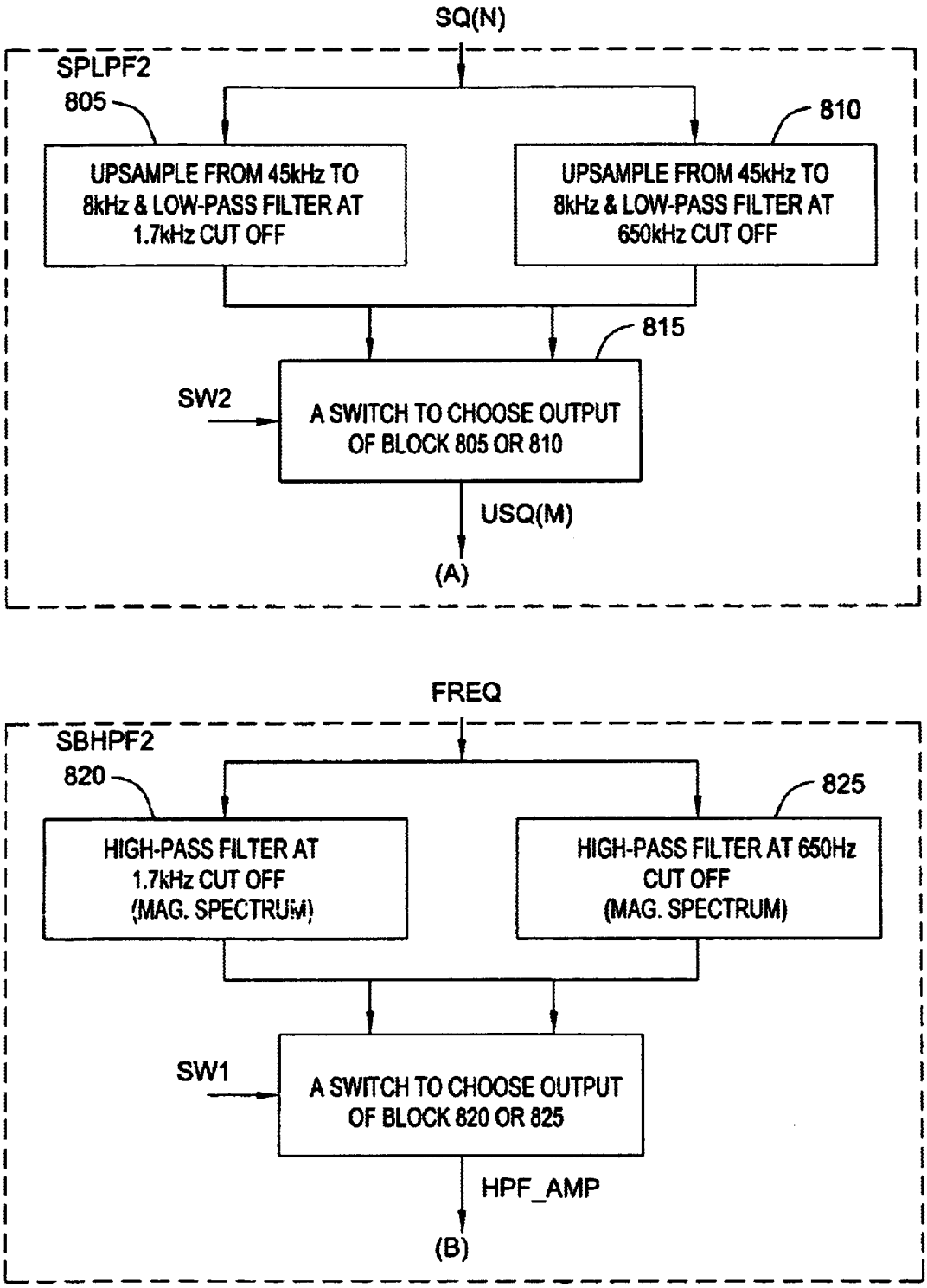
FIG. 8 is a block diagram of block 260 of FIG. 2 of the present invention.

Details of block 260 used in FIG. 2 are shown in FIG. 8B and described in this section. The function of this block is to select the appropriate high-pass filter response for the harmonic decoder. The transfer function of the high-pass filter is $H_h(z)=1-H_L(z)$, where $H_L(z)$ represents the transfer function of the cascade of two low-pass filters (LPF): the RCELP encoder LPF (block 135 of FIG. 1) and the hybrid decoder LPF (block 265 of FIG. 2). The high-pass filtering is performed in the frequency domain. To speed up the filtering operation, the magnitude spectrum of the $H_h(z)$ filter is pre-computed and stored. In FIG. 8-(*b*), block 820 and 825 corresponds to the $H_h(z)$ response calculated based on the hybrid decoder LPF used in block 805 and 810, respectively. The $H_h(z)$ filter coefficients are sampled at pitch harmonics using FREQ output of the harmonic decoder. If SW1 is TRUE, block 830 selects the output of block 825 to be its output, otherwise the output of block 820 is selected.

B.5 Combine Hybrid Waveforms

In FIG. 2, the 20 ms output signal usq(m) of the SBLPF2 block 265 and the 20 ms output hpsq(m) of the Synthesize Sum of Sine Waves block 270 is combined in the time domain by adding two signals sample-by-sample. The resulting signal osq(m) is the decoded version of the original signal, os(m).

C. Harmonic Decoder

C.1 Calculate Complex Spectra

The functionality of the Calculate Complex Spectra block 215 shown in FIG. 2 is identical to the block 210 of Provisional U.S. Provisional Application Serial No. 60/145,591.

C.2 Parameter Interpolation

The functionality of the Parameter Interpolation block 220 shown in FIG. 2 is identical to the block 220 of FIG. 2 of Provisional U.S. Provisional Application Serial No. 60/145,591.

C.3 Estimate SNR

The functionality of the EstSNR block 225 shown in FIG. 2 is identical to the block 230 of Provisional U.S. Provisional Application Serial No. 60/145,591.

C.4 Input Characterization Classifier

The functionality of the Input Characterization Classifier block 230 shown in FIG. 2 is identical to the block 240 of Provisional U.S. Application Serial No. 60/145,591.

C.5 Postfilter

The functionality of the Postfilter block 260 shown in FIG. 2 is identical to the 210 of U.S. Provisional Application Serial No. 60/145,591.

C.6 Calculate Phase

The functionality of the Calculate Phase block 245 shown in FIG. 2 is identical to the block 280 of U.S. Provisional Application Serial No. 60/145,591, except here fundamental phase & beta is calculated outside and provided as input to the block.

C.7 Calculate Frequencies and Amplitudes

The functionality of the Calculate frequencies and Amplitudes block 250 shown in FIG. 2 is identical to the block 270 of U.S. Provisional Application Serial No. 60/145,591.

C.8 Synthesize Sum of Sine Waves

The functionality of the Synthesize sum of sine waves block 255 shown in FIG. 2 is identical to the block 290 of U.S. Provisional Application Serial No. 60/145,591.

D. Adaptive Frame Loss Concealment

D.1 RCELP AFLC Decoding

An error concealment procedure, has been incorporated in the decoder to reduce the degradation in the reconstructed speech because of frame erasures in the bit-stream. This error concealment process is activated when a frame is erased. The mechanism for detecting frame erasure is not defined in this document, and will depend on the application.

Using previously received information the AFLC algorithm reconstruct the current frame. The algorithm replaces the missing excitation signal with one of similar characteristics, while gradually decaying its energy. This is done by using a voicing classifier similar to the one used in ITU-T Recommendation G.729

The following steps are performed when a frame is erased:

D.1.1. Repetition of the synthesis filter parameters;

D.1.2. Attenuation of adaptive and fixed-codebook gains;

D.1.3. Attenuation of the memory of the gain predictor; and

D.1.4. Generation of the excitation signal.

D.1. Repetition of the Synthesis Filter Parameters

The LSP of previous frame is used when a frame is erased.

D.1.2. Attenuation of Adaptive and Fixed-codebook Gains

The fixed-codebook gain is based on an attenuated version of the previous fixed-codebook gain and is given by:

$$GC_Q^{(m)}=0.9604*GC_Q^{(m-1)}$$

where m is the subframe index. The adaptive-codebook gain is based on an attenuated version of the previous adaptive-codebook gain and is given by:

$$GP_Q^{(m)}=0.818*GP_Q^{(m-1)}$$

bounded by $$GP_Q^{(m)}\leqq 0.9$$

D.1.3. Attenuation of the Memory of the Gain Predictor

This is done in a manner similar to that described in ITU-T Recommendation G.729. The current implementation uses a 6-tap MA gain predictor with a decay rate determined by $$\hat{U}^{(m)} = \left(\frac{1}{6}\sum_{i=1}^{6}\hat{U}^{(m-i)}\right) - 1.893687$$

bounded by $$\hat{U}^{(m)} \geq -2.325581$$

where $\hat{U}^{(m)}$ is the quantized version of the base-2 logarithm of the MA prediction error at subframe m.

D.1.4. Generation of Excitation Signal

The generation of the excitation signal is done in a manner similar to that described in ITU-T Recommendation G.729 except that the number of pulses in the fixed-codebook vector (3 or 4) is determined from the number of pulses in the fixed-codebook vector of the previous frame.

D.2 Hybrid AFLC Decoding

Figure 9:
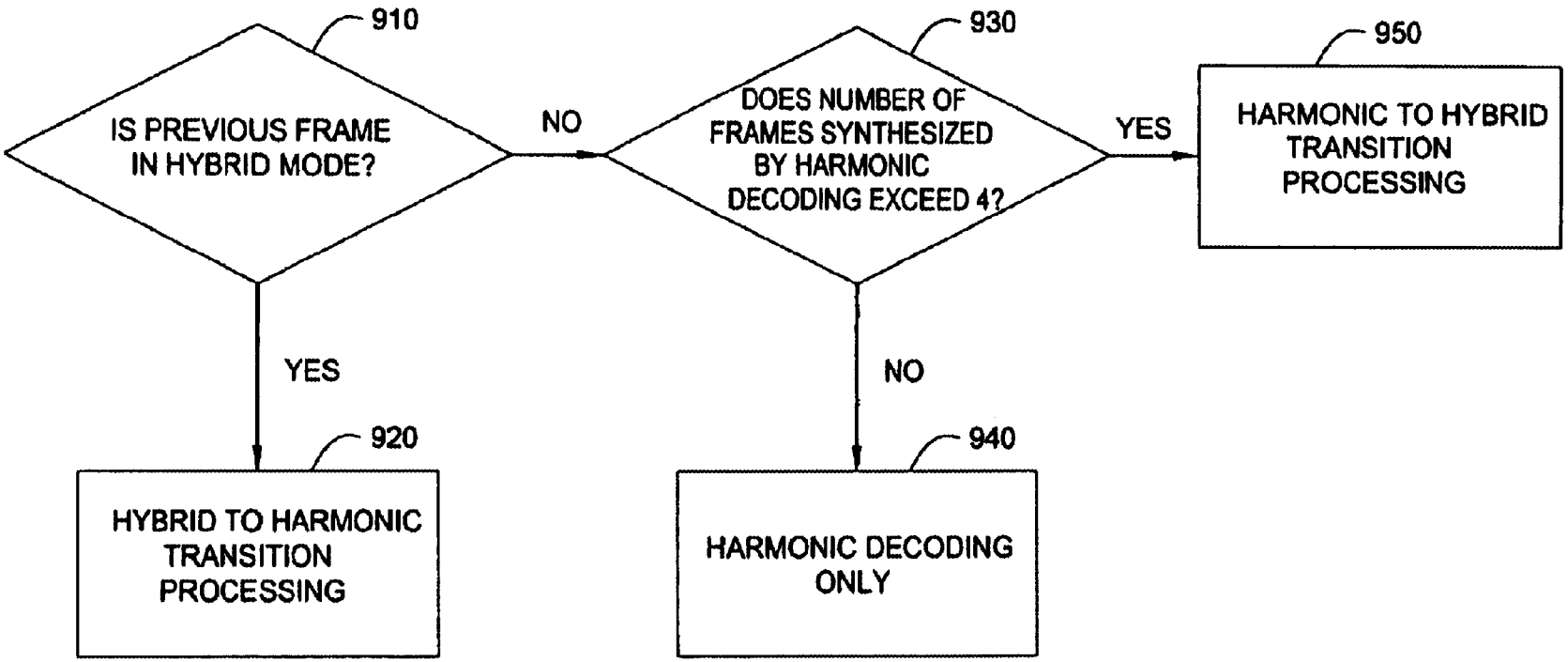
FIG. 9 is a flowchart illustrating the steps for performing Hybrid Adaptive Frame Loss Concealment (AFLC)
Figure 10:
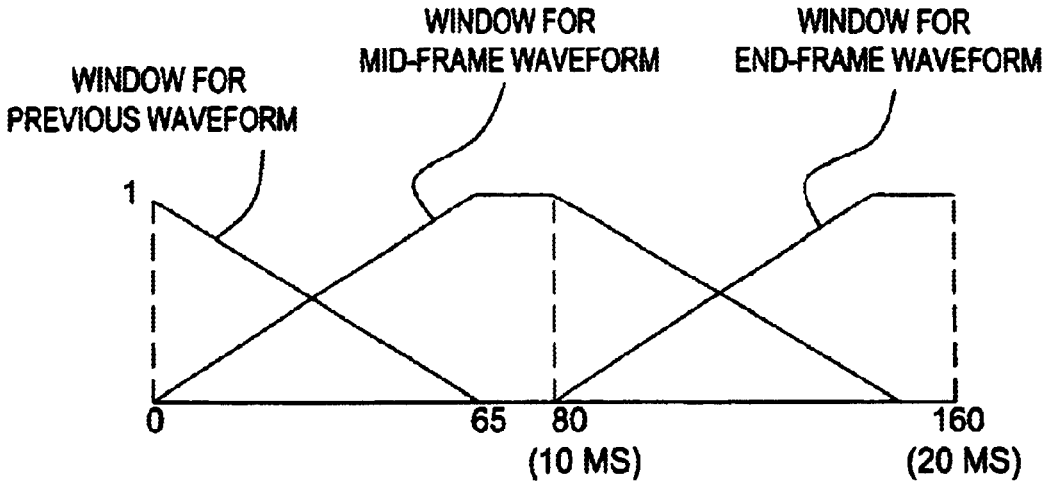
FIG. 10 is a diagram illustrating how a signal is transferred from a hybrid signal to a full band harmonic signal using overlap add windows.
Figure 10:
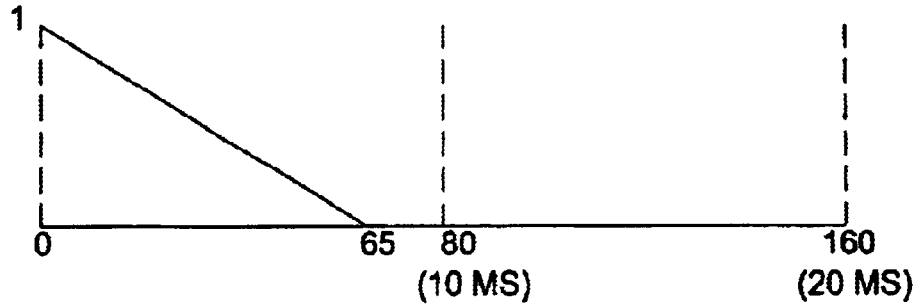
Figure 10:
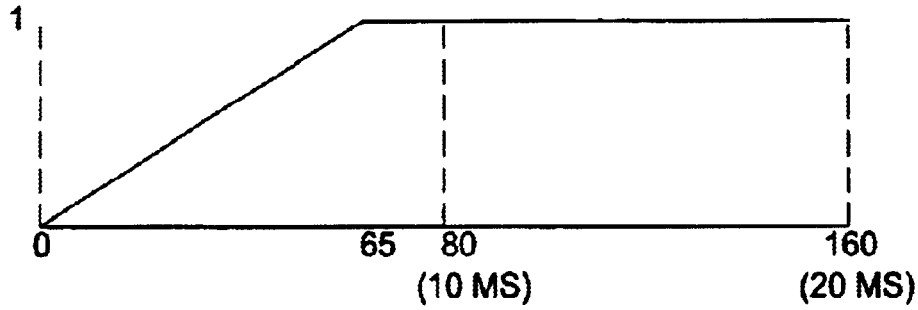

The "Hybrid Adaptive Frame Loss Concealment" (AFLC) procedure is illustrated in FIG. 9. The Hybrid to Harmonic Transition block 930 uses the parameters of the previous frame for decoding. In the first 10 ms subframe, the signal is transferred from a hybrid signal to a full-band harmonic signal using the overlap add windows as shown in FIG. 10. For the second 10 ms subframe, the output speech is reconstructed, as in the harmonic mode, which will be described in a following paragraph. The transition from the hybrid signal to the full band harmonic signal, for the first 10 ms, is achieved by means of the following equation:

$$osq(m)=w1(m)\cdot usq(m)+w1(m)\cdot hpsq_1(m)+w2(m)\cdot fbsq(m)$$

where $$w2(m)=1-w1(m)$$

and osq(m) is the output speech, w1(m) and w2(m) are the overlap windows shown in FIG. 10, hpsq_1(m) is the previous high-pass filtered harmonic signal, and fbsq(m) is the full-band harmonic signal for the current frame. Note that usq(m) is the base band signal from the RCELP AFLC for the current frame. The RCELP coder has its own adaptive frame loss concealment (AFLC) which is described in the section titled "RCELP AFLC Decoding."

In the Harmonic Mode (block 940), the harmonic decoder synthesizes a full-band harmonic signal using the previous frame parameters: pitch, voicing, and spectral envelope. The up-sampled base-band signal usq(m) decoded from the RCELP AFLC is discarded and the full-band harmonic signal is used as the output speech osq(m). After a lost frame, the Hybrid AFLC runs in the harmonic mode for another three frames to allow the RCELP coder to recover.

In the Hybrid Mode (block 960), the output speech osq(m) is equal to the sum of the high-pass filtered harmonic signal hpsq(m) and the base band signal usq(m) for the whole frame, as described in the section titled "Combine Hybrid Waveforms."

The Harmonic to Hybrid Transition block 980 synthesizes the first 10 ms subframe, in transition from a full band harmonic signal to a hybrid signal, using the overlap-add windows, as depicted in FIG. 10. For the second 10 ms subframe, the output speech is reconstructed, as in the hybrid mode. The transition from the full band harmonic signal to the hybrid signal, for the first 10 ms is achieved by the following equation:

$$osq(m)=w1(m)\cdot fbsq_1(m)+w2(m)\cdot hpsq(m)+w2(m)\cdot usq(m)$$

where fbsq_1(m) is the previous full band harmonic signal and hpsq(m) is the high-pass filtered harmonic signal for the current frame. Note that usq(m) is the base band signal from the RCELP for the current frame. After this transition completed, the codec will operate normally until the next frame loss is detected.

What has been described herein is merely illustrative of the application of the principles of the present invention. For example, the functions described above and implemented as the best mode for operating the present invention are for illustration purposes only. Other arrangements and methods may be implemented by those skilled in the art without departing from the scope and spirit of this invention.

What is claimed is:

1. A system for processing an input signal, the system comprising:

means for separating the input signal into at least two sub-band signals;

first means for encoding one of said at least two sub-band signals using a first encoding algorithm to produce at least one encoded output signal, said first means for encoding further comprising means for detecting a gain mismatch between said at least two sub-band signals; and means for adjusting said gain mismatch detected by said detecting means; and second means for encoding another of said at least two sub-band signals using a second encoding algorithm to produce at least one other encoded output signal, where said first encoding algorithm is different from said second encoding algorithm.

2. The system of claim 1, further comprising means for multiplexing said at least one encoded output signal from said first means for encoding with said one other encoded output signal from said second means for encoding to produce a multiplexed encoded output signal.

3. The system of claim 1, wherein said first encoding means uses a first plurality of parameters and said second encoding means uses a second plurality of parameters, wherein said first plurality of parameters is separately calculated from said second plurality of parameters.

4. The system of claim 1, wherein said first and second means for encoding uses at least one parameter.

5. The system of claim 4, wherein at least one parameter is shared by said first and second encoding means.

6. The system of claim 1, further comprising means for receiving and substantially reconstructing said at least two sub-band signals from said multiplexed encoded output signal; and means for combining said substantially reconstructed said at least two sub-band signals to substantially reconstruct said input signal.

7. The system of claim 6, wherein said means for combining further comprises means for maintaining waveform phase alignment between said at least one encoded output signal from said first means for encoding with said one other encoded output signal from said second means for encoding.

8. The system of claim 6, wherein said means for reconstructing further comprises:

means for decoding said at least one encoded output signal at a first sampling rate using a first decoding algorithm; and means for decoding said at least one other encoded output signal at a second sampling rate using a second decoding algorithm.

9. The system of claim 8, wherein said means for reconstructing further comprises means for adjusting one of said first and second sampling rates such that said first sampling rate is equal to said second sampling rate.

10. The system of claim 1, wherein said first means for encoding is a waveform encoder.

11. The system of claim 10, wherein said waveform encoder is selected from the group consisting of at least a pulse code modulation (PCM) encoder, adaptive differential PCM encoder, code excited linear prediction (CELP) encoder, relaxed CELP encoder and transform coding encoder.

12. The system of claim 1, wherein said second means for encoding Is a parametric encoder.

13. The system of claim 12, wherein said parametric encoder is selected from the group consisting of at least a sinusoidal transform encoder, harmonic encoder, multi band excitation vocoder (MBE) encoder, mixed excitation linear prediction (MELP) encoder and waveform interpolation encoder.

14. A system for processing an input signal, the system comprising:

a hybrid encoder comprising:

means for separating the input signal into a first signal and a second signal;

means for detecting a gain mismatch between said first signal and said second signal;

means for adjusting for said gain mismatch detected by said detecting means;

means for processing the first signal to derive a baseband signal;

means for encoding the baseband signal using a relaxed code excited linear prediction (RCELP) encoder to derive a baseband RCELP encoded signal;

means for encoding the second signal using a harmonic encoder to derive a harmonic encoded signal; and means for multiplexing said baseband RCELP encoded signal with said harmonic encoded signal to form a multiplexed hybrid encoded signal.

15. The system of claim 14, wherein said means for encoding said baseband signal and means for encoding said second signal uses at least one parameter.

16. The system of claim 15, wherein said at least one parameter is shared by said means for encoding said baseband signal and said means for encoding said second signal.

17. The system of claim 14, further comprising:

a decoder comprising:

means for substantially reconstructing said first and second signals from said multiplexed hybrid encoded signal; and means for combining said substantially reconstructed first and second signals to substantially reconstruct said input signal.

18. The system of claim 17, wherein said means for substantially reconstructing further comprises:

means for decoding said first signal at a first sampling rate using a first decoding algorithm; and means for decoding said second signal at a second sampling rate using a second decoding algorithm.

19. The system of claim 18, wherein said means for reconstructing further comprises means for adjusting one of said first and second sampling rates such that said first sampling rate is equal to said second sampling rate.

20. The system of claim 17, wherein said combining means further comprises means for maintaining waveform phase alignment.

21. The system of claim 17, wherein said means for decoding further comprises means for detecting a gain mismatch between said first and second signals; and means for adjusting for said gain mismatch detected by said detecting means.

22. A hybrid encoder for encoding audio and speech signals, the hybrid encoder comprising:

means for separating an input signal into a first signal and a second signal;

means for detecting a gain mismatch between said first signal and a second signal;

means for adjusting for said gain mismatch detected by said detecting means;

means for processing the first signal to derive a baseband signal;

means for encoding said baseband signal using a relaxed code excited linear prediction (RCELP) encoder to derive a baseband RCELP encoded signal;

means for encoding the second signal using a harmonic encoder to derive a harmonic encoded signal; and means for combining said baseband RCELP encoded signal with said harmonic encoded signal to form a combined hybrid encoded signal.

23. The hybrid encoder of claim 22, wherein the means for encoding said second signal comprises:

means for high-pass filtering and buffering an input signal comprised of a plurality of consecutive frames to derive a preprocessed signal, ps(m);

means for analyzing a current frame and at least one previously received frame from among said plurality of frames to derive a pitch period estimate;

means for analyzing said pre-processed signal, ps(m), and said pitch period estimate to estimate a voicing cutoff frequency and to derive an all-pole model of the frequency response of the current speech frame dependent on said pitch period estimate, said voicing cutoff frequency, and ps(m);

means for outputting a line spectral frequency (LSF) representation of the all-pole model and a frame gain of the current frame; and means for quantizing said LSF representation, said voicing cutoff frequency, and said frame gain to derive a quantized LSF representation, a quantized voicing cutoff frequency, and a quantized frame gain.

24. The hybrid encoder of claim 22, wherein said means for encoding said baseband signal using a RCELP encoder comprises:

means for deriving a preprocessed signal, shp(m), from said input signal comprised of a plurality of frames where each frame is further comprised of at least two sub-frames;

means for upsampling said pre-processed signal, shp(m) to derive an interpolated baseband signal, is(i), at a first sampling rate;

means for deriving a baseband signal, s(n), at a second sampling rate, wherein said second sampling rate is less than said first sampling rate;

means for refining the pitch period estimate to derive a refined pitch period estimate;

means for quantizing the refined pitch period estimate to derive a quantized pitch period estimate;

means for linearly interpolating the quantized pitch period estimate to derive a pitch period contour array, ip(i);

means for generating a modified baseband signal, sm(n), having a pitch period contour which tracks the pitch period contour array, ip(i); and means for controlling a time asynchrony between said baseband signal, s(n), and said modified baseband signal, sm(n).

25. The hybrid encoder of claim 24, wherein said second sampling rate is a Nyquist rate.

26. The hybrid encoder of claim 24, wherein the means for refining the pitch period estimate further comprises means for using a window centered at the end of one of said plurality of frames having a window length equal to one of the pitch period estimate and an amount bounded by a look-ahead output of the hybrid encoder.

27. The hybrid encoder of claim 24, wherein said means for deriving said baseband signal, s(n), at said second sampling rate comprises decimating said interpolated baseband signal, is(i), at said second sampling rate.

28. The hybrid encoder of claim 24, wherein said means for refining the pitch period estimate comprises:

means for receiving said pitch period estimate from said harmonic encoder;

means for constructing a search window encompassing said pitch period estimate; and means for searching within said search window for determining an optimal time lag which maximizes a normalized correlation function of the signal, shp(m).

29. The hybrid encoder of claim 24, further comprising means for generating an adaptive codebook vector, v(n), based on a previously quantized excitation signal, u(n).

30. The hybrid encoder of claim 29, wherein the means for generating said adaptive codebook vector, v(n), comprises:

means for determining a last pitch period cycle of said quantized excitation signal, u(n);

means for stretching/compressing the time scale of the last pitch period cycle of said previously quantized excitation signal, u(n); and means for copying said stretched/compressed last pitch period cycle in a current subframe according to said pitch period contour array, ip(i).

31. The hybrid encoder of claim 24, further comprising means for converting an array of quantized line spectral frequency (LSF) coefficients into an array of baseband linear prediction (LPC) coefficients.

32. The hybrid encoder of claim 31, wherein the LPC array is used to derive coefficients associated with a perceptual weighting filter, and are further used to update coefficients associated with a short-term synthesis filter.

33. The hybrid encoder of claim 24, further comprising means for finding an optimal combination of fixed codebook pulse locations and pulse signs which minimizes the energy of a weighted coding error signal, ew(n), within a current subframe.

34. The hybrid encoder of claim 24, further comprising means for calculating and quantizing adaptive and fixed codebook gains.

35. A hybrid decoder for decoding a hybrid encoded signal, the decoder comprising:

processing means comprising:

means for receiving a hybrid encoded bit-stream from a communication channel;

means for demultiplexing the received bit-stream into a plurality of bit-stream groups according to at least one quantizing parameter;

means for unpacking the plurality of bit-stream groups into quantizer output indices;

means for decoding the quantizer output indices into quantized parameters; and means for providing the quantized parameters to a relaxed code excited linear prediction (RCELP) decoder to decode a baseband RCELP output signal, said quantized parameters further being provided to a harmonic decoder to decode a full-band harmonic signal;

means for detecting a gain mismatch between said baseband RCELP outDut signal and said full-band harmonic signal;

means for adjusting for said gain mismatch detected by said detecting means; and means for combining outputs from said RCELP decoder and said harmonic decoder to provide a full-band output signal.

36. The hybrid decoder of claim 35, wherein the RCELP decoder further comprises means for converting a decoded full-band line spectral frequency (LSF) vector into a baseband linear prediction coefficient (LPC) array.

* * * * *

UNITED STATES PATENT AND TRADEMARK OFFICE

CERTIFICATE OF CORRECTION

PATENT NO. : 6,691,082 B1 
DATED : February 10, 2004
INVENTOR(S) : Joseph Gerard Aguilar et al.

It is certified that error appears in the above-identified patent and that said Letters Patent is hereby corrected as shown below:

Title page,
Insert Item:

-- [73] Assignee: Lucent Technologies Inc., Murray Hill, N.J. --

Signed and Sealed this

Seventh Day of September, 2004

JON W. DUDAS
*Director of the United States Patent and Trademark Office*